US009481548B2

(12) United States Patent
Siddiqui et al.

(10) Patent No.: US 9,481,548 B2
(45) Date of Patent: Nov. 1, 2016

(54) SENSOR-BASED ELEVATOR SYSTEM AND METHOD USING THE SAME

(71) Applicant: KING FADH UNIVERSITY OF PETROLEUM AND MINERALS, Dhahran (SA)

(72) Inventors: Abdul Jabbar Siddiqui, Dhahran (SA); Hamza Ijaz Abbasi, Atlanta, GA (US); Tarek R. Sheltami, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 502 days.

(21) Appl. No.: 14/050,236

(22) Filed: Oct. 9, 2013

(65) Prior Publication Data

US 2015/0096843 A1 Apr. 9, 2015

(51) Int. Cl.
*B66B 1/24* (2006.01)
*B66B 1/34* (2006.01)

(52) U.S. Cl.
CPC ..... *B66B 1/2416* (2013.01); *B66B 1/2458* (2013.01); *B66B 1/3476* (2013.01)

(58) Field of Classification Search
CPC .. B66B 1/2416; B66B 1/2458; B66B 1/3476
USPC ..... 187/247, 380–388, 391, 392, 393
See application file for complete search history.

(56) References Cited

U.S. PATENT DOCUMENTS 4,852,696 A * 8/1989 Fukuda ..... B66B 3/008 187/392
4,958,707 A * 9/1990 Yoneda ..... B66B 5/0031 187/247
5,487,451 A * 1/1996 Hughes ..... B66B 1/3476 187/392
6,202,799 B1 3/2001 Drop
6,257,373 B1 * 7/2001 Hikita ..... B66B 1/2458 187/387

(Continued)

FOREIGN PATENT DOCUMENTS

CN 101116367 A 1/2008
CN 101955094 1/2011

(Continued)

OTHER PUBLICATIONS

Seng-Yong Lau et al., "Sensor Networks for Everyday Use: The BL-Live Experience", IEEE International Conference onSensor Networks, Ubiquitous, and Trustworthy Computing, 2006., Jun. 5-7, 2006, Taichung, Taiwan, 7 pages.

(Continued)

*Primary Examiner* — Anthony Salata
(74) *Attorney, Agent, or Firm* — Richard C. Litman

(57) ABSTRACT

Smart elevator systems and methods for controlling an elevator system use sensors that transmit data to a processor in a network system for use in operating an elevator system. The elevator system can include a system connected to a LAN, WAN, intranet, internet, etc. and is capable of exchanging data with and retrieving data therefrom. In the smart elevator systems, there are a number of wireless sensors that detect and transmit information on a number of people requesting elevator transport. The smart elevator system uses that information to select or determine one or more transport paths for one or more elevators to follow and, therefore, can be beneficial in enhancing efficient use of one or more elevators in an elevator system to service persons awaiting elevator service.

18 Claims, 14 Drawing Sheets

(56) References Cited

U.S. PATENT DOCUMENTS

| | | | | |
|---|---|---|---|---|
| 6,601,679 | B2 | 8/2003 | Crenella et al. | |
| 6,986,408 | B2 * | 1/2006 | Takeuchi | B66B 1/14 187/247 |
| 6,988,071 | B1 | 1/2006 | Gazdzinski | |
| 7,552,802 | B2 * | 6/2009 | Hirade | B66B 1/2458 187/383 |
| 7,823,702 | B2 * | 11/2010 | Hirade | B66B 5/0012 187/247 |
| 8,020,672 | B2 * | 9/2011 | Lin | B66B 1/34 187/316 |
| 8,096,388 | B2 * | 1/2012 | Nakamura | B66B 3/00 187/391 |
| 8,584,811 | B2 * | 11/2013 | Kuoppala | B66B 1/468 187/316 |
| 8,857,569 | B2 * | 10/2014 | Friedli | B66B 5/0012 187/384 |
| 8,905,195 | B2 * | 12/2014 | Finschi | B66B 1/2458 187/249 |
| 2007/0041352 | A1 | 2/2007 | Frankel et al. | |
| 2015/0034426 | A1 * | 2/2015 | Armistead | B66B 19/007 187/392 |

FOREIGN PATENT DOCUMENTS

| | | | |
|---|---|---|---|
| WO | WO 2007020907 | A1 | 2/2007 |
| WO | WO 2009078536 | A1 | 6/2009 |
| WO | WO 2011009356 | A1 | 1/2011 |

OTHER PUBLICATIONS

Z. Shuai et al., "Traffic Modeling and Prediction Using Camera Sensor Networks", *ICDSC 2010*, Aug. 31-Sep. 4, 2010, Atlanta, GA, USA, pp. 49-56.

Hamza Ijaz Abbasi et al., "Implementation of Smart Elevator System based on Wireless Multi-hop AdHoc Sensor Networks", 2011, 2nd IEEE Conference on NESEA, Dec. 8-9, 2011, Perth Australia, 6 pages.

* cited by examiner

SENSOR-BASED ELEVATOR SYSTEM AND METHOD USING THE SAME

BACKGROUND OF THE INVENTION

1. Field of the Invention

The present invention relates to an elevator system, and particularly to a smart elevator system using wireless sensor networks to acquire data relating to operating an elevator system.

2. Description of the Related Art

The elevator is a type of transport equipment that moves people or goods between floors (levels) of a structure, such as a building, a vessel, or other structures. Elevators are generally powered by electric motors that drive traction cables. Elevators are typically used in office buildings, airports, shopping malls, and other large structures. These devices transport large numbers of persons and equipment between two or more locations in a structure.

Elevators can be used a variety of ways and are widely used throughout the world. Elevators can operate in a variety of forms such as freight elevators, stage lifts, dumbwaiter elevators, and vehicle elevators. Although elevators have been advanced to perform a variety of tasks, a primary use is in transporting passengers throughout a structure, such as a building. A person or passenger awaiting an elevator car may spend numerous minutes waiting on an elevator car for transport. A passenger may also spend numerous minutes waiting inside the elevator car while passengers depart and load.

Current elevators can use technology to make passenger transport faster, easier, and even more energy efficient. These smart elevators can have various technological advancements over its predecessors and are continuing to evolve. For example, some smart elevators can calculate the weight of passengers to prevent too many people from getting on. Other smart elevators are able to route passengers to their requested location based on the number of passengers with a similar request. These smart elevators typically use a standard hardwire connection in transmitting and processing passenger requests.

Wireless Sensor-Actor Networks (WSANs) have attracted much interest in recent years. A typical WSAN consists of a larger set of miniaturized sensor nodes reporting their data to significantly fewer actor (actuator) nodes. Sensors probe their surroundings and report their findings to one or multiple actors, which processes the collected sensor reports and respond to emerging events of interest. The use of WSANs in assisting in the transport of people is expected to make elevators more efficient and decrease elevator traffic delay. Manufacturers and business owners believe the market for smart elevators is expected to grow as elevator manufacturers look for ways to move people around faster and more efficiently.

Elevators incorporating wireless sensor networks in the use for transporting people are known. Elevators of this type include, for example, published PCT patent application WO 2007020907 A1, which teaches a system which calls elevator cars using a wireless network of nodes. A mobile node at an unknown location broadcasts a request packet. The request packet includes an identification of the mobile node and an elevator call command. One or more fixed nodes at known locations measure signal strength of the received request packet and determine a known location of the mobile node based on the signal strength and the known locations of the fixed nodes, and call an elevator car according to the known location of the mobile node and the elevator call command.

Also, for example, the published PCT patent application WO 2011009356 A1, is directed towards a wireless system for detecting identification cards of mobile users within a building. In this system, an elevator automatically responds to detection of a target card in the vicinity of an elevator sensor.

There appears to be a need for an elevator system to incorporate the use of wireless sensor networks in operating elevators by allowing the sensor nodes to receive the approximate location of people and the approximate number of persons in various locations and to provide a method of using that information to determine efficient means to transport persons. Thus, a smart elevator system addressing the aforementioned problems is desired.

SUMMARY OF THE INVENTION

Embodiments of apparatuses include a smart elevator system and also include methods for operating the smart elevator system in directing a plurality of elevator cars using a plurality of sensors and computer processors. Various embodiments of the smart elevator system use a wireless sensor network. The wireless sensor network is based on sensor nodes located on each floor of a structure, such as a building, a vessel, or other structures, for example. The sensors can communicate with one another in a multi ad-hoc fashion. The sensors can also communicate with a central processor that receives data regarding elevator requests. Each sensor on a respective floor is aware of the global traffic conditions (for example, a number of persons awaiting elevator service in a downward or upward direction on that respective floor) in order to efficiently decide where the elevator should be directed and stopped. The information gathered through the respective sensors on each floor can be used in a fashion of an ad hoc network to make a determination of the new floor location the elevator should proceed to based on the information received from the sensors. The information gathered may also be transmitted to a central computer processor for determining a single elevator car's next floor location or for determining elevator stops for a multitude of elevator cars in a structure, such as a building, for example.

In various embodiments, sensors are placed in locations near each of the various floor elevator doors. The sensors are capable of detecting a number of persons awaiting the elevator. The sensors are also capable of detecting an approximate number of persons to travel in an upward floor location and an approximate number of people to travel in a downward floor location. In the instance of smart elevators, wireless sensors can also detect a number of people waiting for elevator service, whether an elevator car is empty, and the approximate location of people in a particular area, for example.

An embodiment of a method for controlling the elevator in a smart elevator system is the sensor first detecting the approximate number of persons awaiting elevator service. In one embodiment, the sensors communicate the person or passenger information to a floor controller, which can act as a receiving processor, which is associated to the elevator door. This method of communication by a sensor to the floor controller can be replicated on every floor in a structure, such as a building, for each of the sensor node's respective controller associated to its respective elevator door. The controller then communicates with one or more controllers, e.g., computer processors, on the floors immediately above and immediately below in an ad hoc approach. The elevator has a scheduler, e.g., a computer processor, which is associated to the elevator that receives the traffic information on the floors immediately above and below that floor from that current floor's controller. Based on the information received, the scheduler runs a designated program, such as to implement an algorithm, to select an elevator path, remain on the current floor, or return to a default location.

Also, in an embodiment, the sensors transmit the passenger traffic information to the respective floor controller, e.g., a computer processor, which is associated to the elevator door on a corresponding floor. The individual floor controllers then transmit the traffic information for each individual floor to a central scheduling dispatcher, e.g., a computer processor, which acts as a primary scheduling control device. Based on the information received the central scheduling dispatcher unit processes the information, runs a designated program to select the elevator path, and directs the elevator according to the selection.

In another embodiment, the sensors transmit the passenger traffic information to the respective floor controller that is associated to the elevator door on a corresponding floor. The individual floor controllers then transmit the traffic information for each individual floor to a central scheduling dispatcher, e.g., a computer processor, which acts as a secondary scheduling device. In this embodiment, there can be several central scheduling dispatchers corresponding to a number of elevator cars in a structure, such as a building. Each central scheduling dispatcher transmits passenger traffic information to an overall elevator dispatcher unit, e.g. a computer processor, which acts as a primary scheduling control device, for determining elevator transport paths. Based on the information received from the central scheduling dispatcher units, the overall elevator dispatcher unit processes the information, runs a designated program to select one or more elevator transport paths for one or more elevator cars, and transmits the selected elevator transport paths for the one or more elevator cars to the central scheduling dispatchers corresponding to the one or more elevator cars.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

With reference now to the drawings, in particular to FIGS. 1-10, thereof, apparatuses and methods for an elevator system using sensors to operate a plurality of elevator cars, such as including typical elevator cars as can be powered by electric motors that drive traction cables controlled by an elevator car's operational controller or processor to move the elevator car, embodying features, principles, and concepts of various embodiments of the elevator system using sensors will be described. The smart elevator system can include a system connected to a local area network (LAN), a wide area network (WAN), intranet, internet, etc. and is capable of exchanging data with and retrieving data therefrom, for example.

Figure 1A:
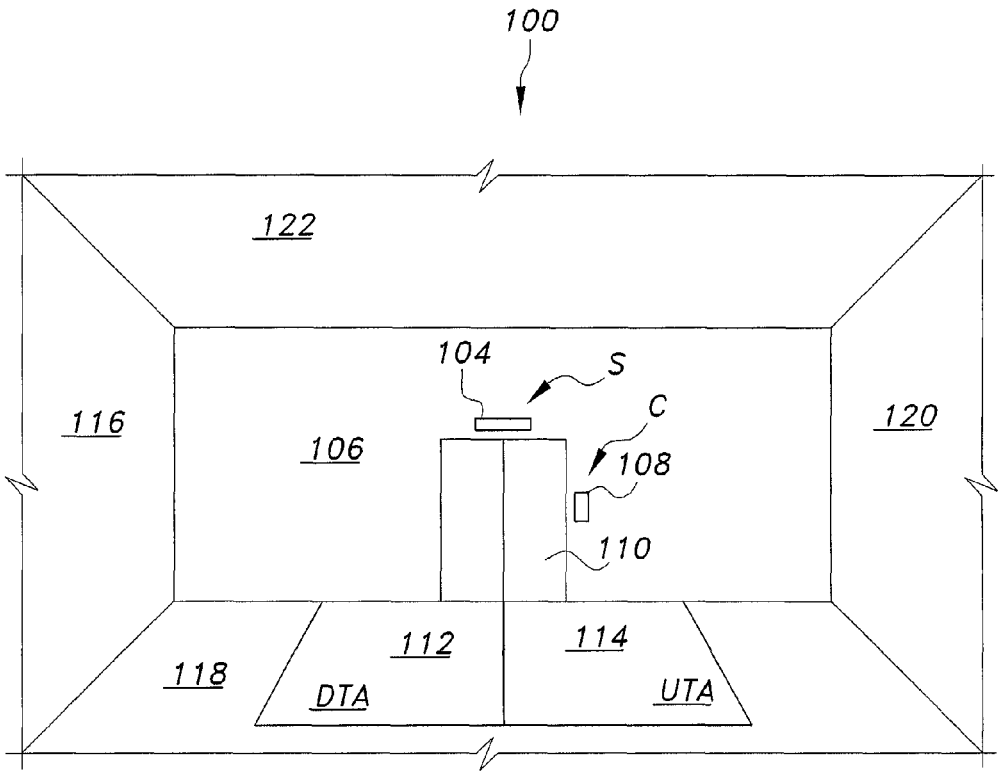
FIG. 1A is a front view of an embodiment of an elevator waiting area surrounding an elevator door, the sensor, the controller, and the downward and upward areas according to the present invention.
Figure 1B:
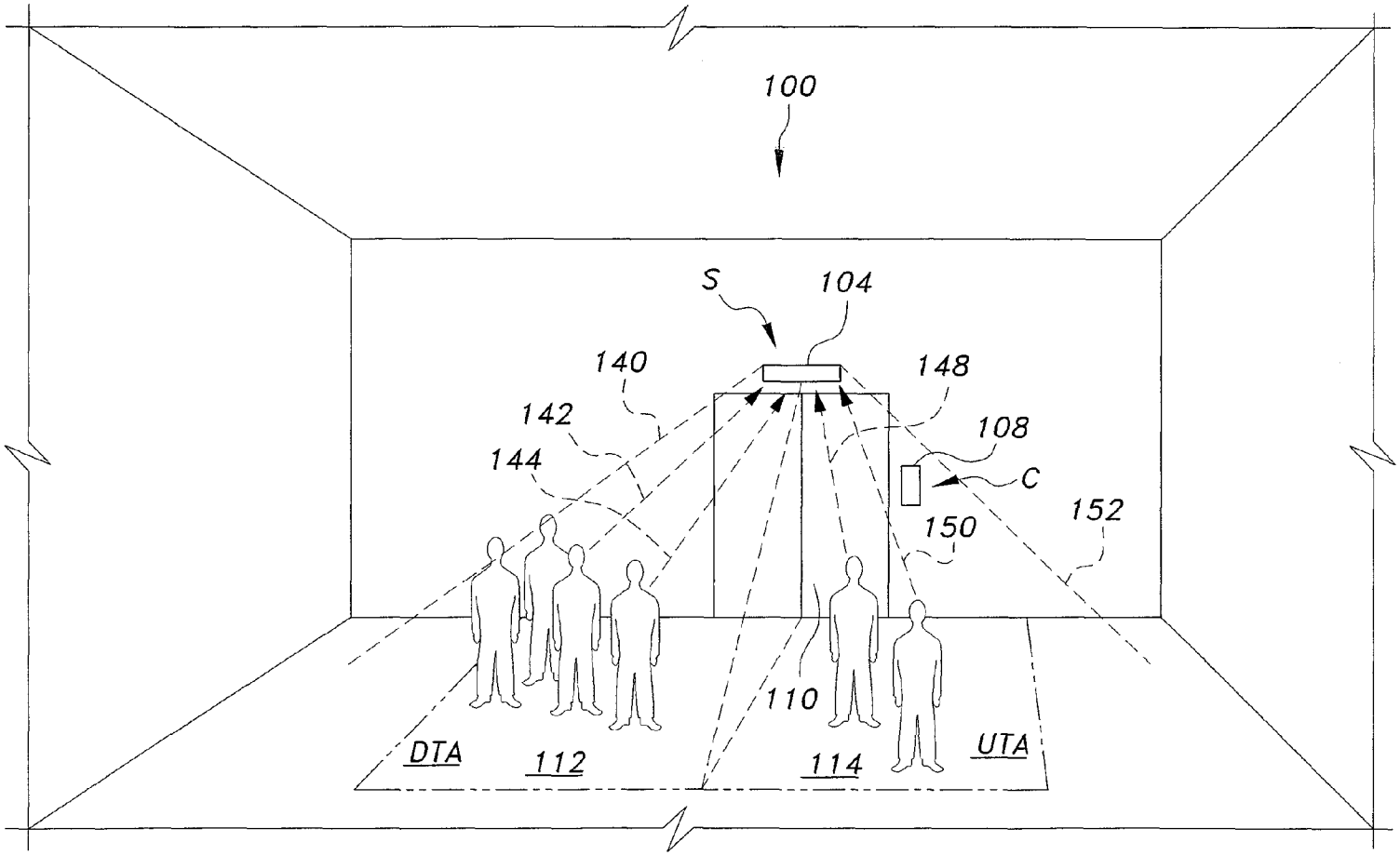
FIG. 1B is a front view of an embodiment of an elevator waiting area surrounding an elevator door using a sensor for detecting the traffic direction of persons according to the present invention.

To assist in understanding the various embodiments of the operation of at least one elevator car in a smart elevator system, reference can be made to FIG. 1A and FIG. 1B. FIG. 1A illustrates a front view of an embodiment of an elevator waiting area 100 surrounding an elevator door using a wireless sensor for detecting the requested traffic direction of a number of people. In FIG. 1A there is illustrated in the elevator waiting area 100 a floor elevator door 110, a sensor (S) 104 directly above the floor elevator door 110, a controller (C) 108, such as a floor controller, adjacent to the floor elevator door 110, a downward traffic area (DTA) or transport zone 112, an upward traffic area (UTA) or transport zone 114, walls 106, 116, 120, a ceiling 122, and a floor 118. The downward traffic area or transport zone 112 is the area or zone where a sensor 104 can detect a number of persons who are awaiting elevator service to go to a lower floor and can be indicated in the elevator waiting area 100, such as illustrated in FIG. 1A and FIG. 1B, and the downward traffic area or transport zone 112 as can be optionally indicated or not indicated on a lowest floor serviced by an elevator car, for example. The upward traffic area or transport zone 114 is the area or zone where the sensor 104 can detect a number of persons who are awaiting elevator service to go to a higher floor and can be indicated in the elevator waiting area 100, such as illustrated in FIG. 1A and FIG. 1B, and the upward traffic area or transport zone 114 as can be optionally indicated or not indicated on a highest floor serviced by an elevator car, for example. The placement of a person in either the downward traffic area or transport zone 112 or the upward traffic area or transport zone 114 enables the sensor 104 to detect a person's requested service direction and transmit that information to the controller 108.

FIG. 1B builds onto the illustration of the elevator waiting area 100 of FIG. 1A and depicts the sensor 104 receiving data at 140, 142 and 144 of a number of persons waiting in the downward traffic area or transport zone 112 and the sensor 104 receiving data at 148, 150 and 152 of a number of passengers waiting in the upward traffic area or transport zone 114. FIG. 1B shows the sensor 104 receiving information shown by data signals at 140, 142, 144, 148, 150 and 152 that there are four people waiting in the downward traffic area or transport zone 112 and two people waiting in the upward traffic area or transport zone 114.

Figure 1C:
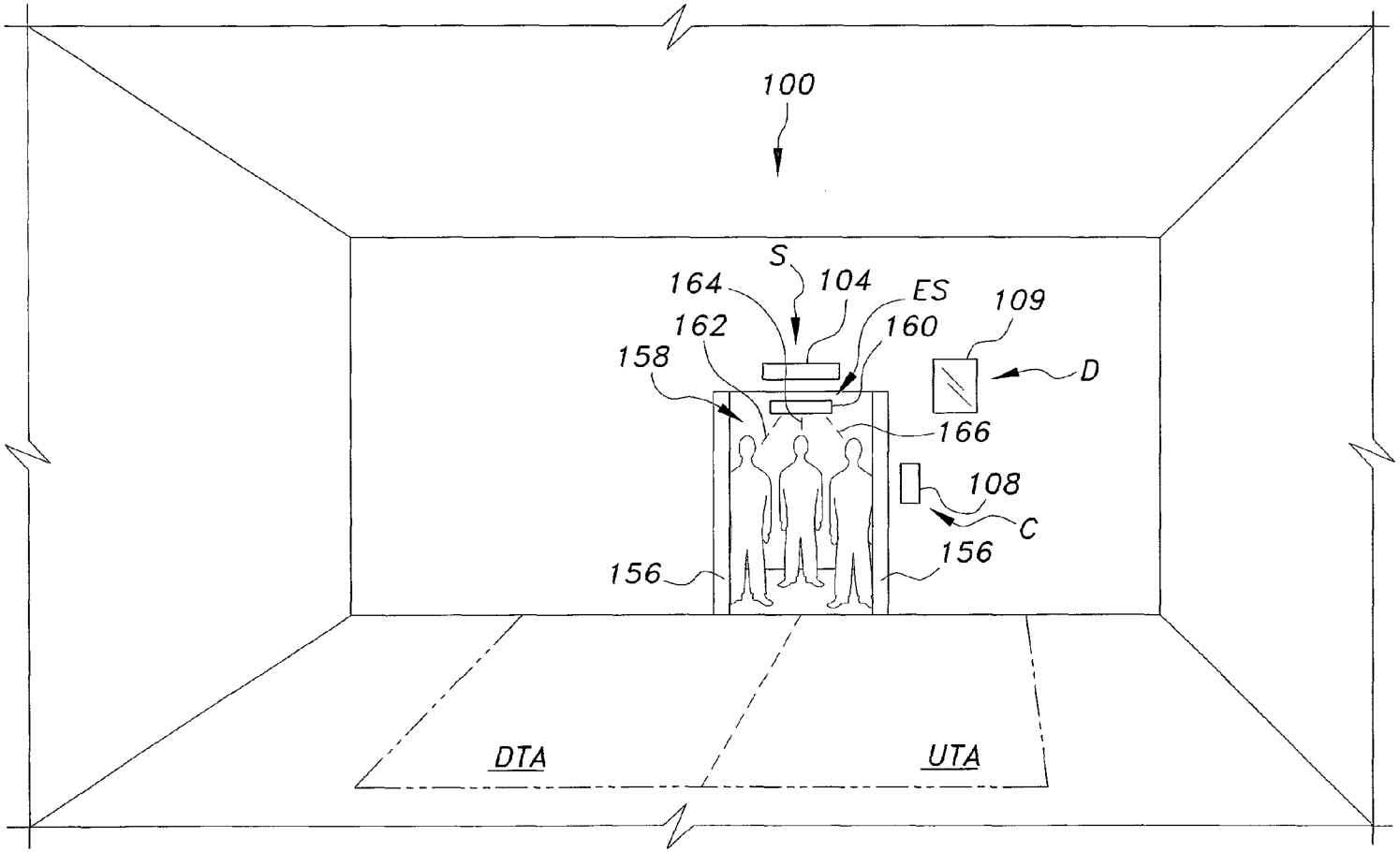
FIG. 1C is a front view of an embodiment of an elevator waiting area surrounding an elevator door using a sensor for detecting the number of person in an area inside an elevator car according to the present invention.

Continuing with reference to FIG. 1C, the elevator waiting area 100 of FIG. 1A and FIG. 1B is illustrated. FIG. 1C depicts the sensor (S) 104 and also depicts an inner elevator sensor (ES) 160, the controller (C) 108, a display (D) 109, an open elevator door 156, and an inner area 158 inside of the elevator car. In FIG. 1C the inner elevator sensor 160 scans and detects a number of passengers currently in the elevator car. The display 109, such as a digital display, can indicate one or more of the number of passengers inside the elevator car, an indicator to specify whether the elevator car is full, and an estimated time of arrival for the elevator car, for example. Also the display 109 can be positioned at various suitable locations so as to be accessible to persons using the smart elevator system, such as positioned near the elevator door, for example.

Figure 2:
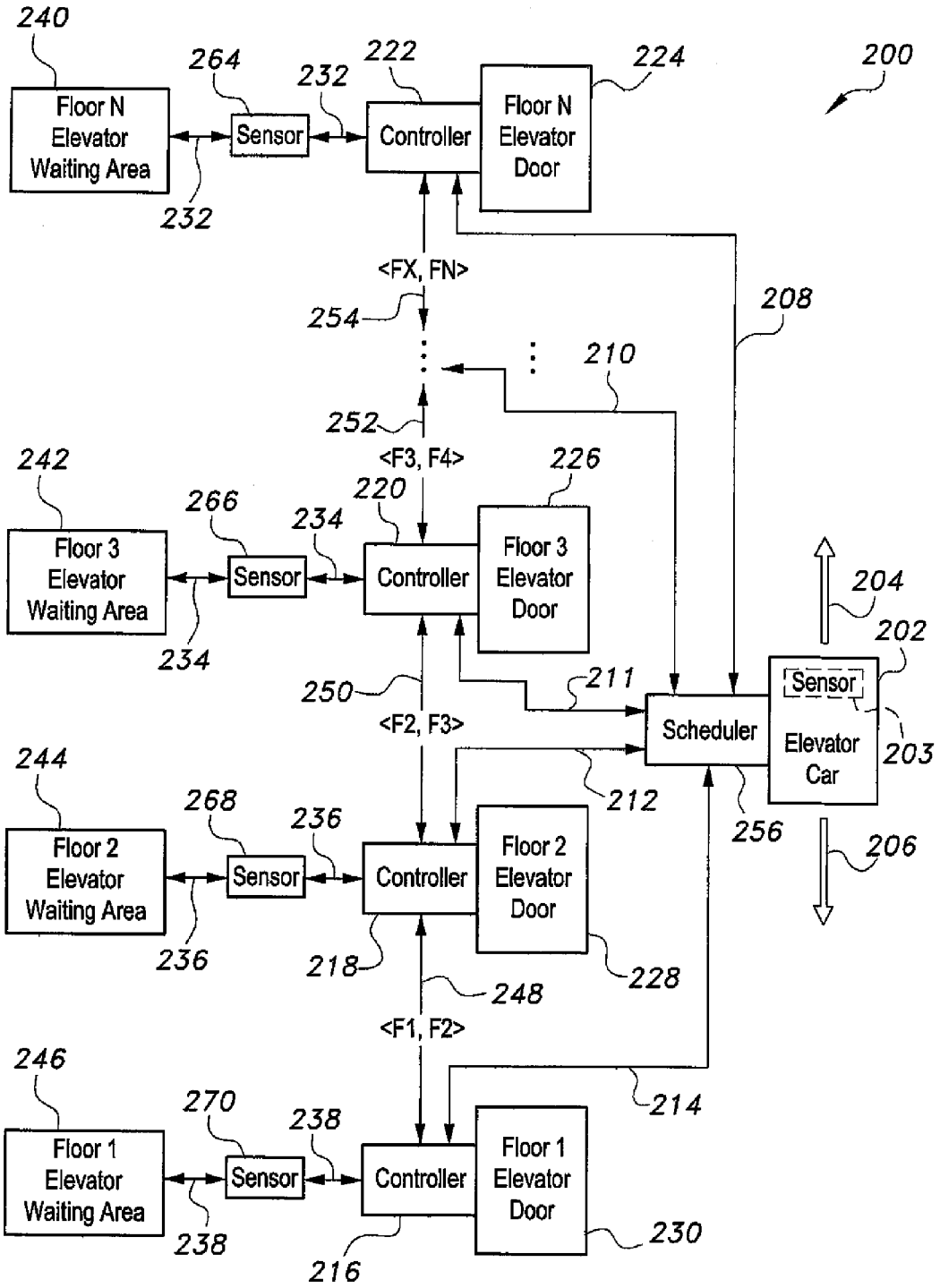
FIG. 2 is a block diagram of an embodiment of a smart elevator system that includes a primary processor with bidirectional communication to multiple controllers on various elevator floors regarding traffic information according to the present invention.

FIG. 2 illustrates an embodiment of a smart elevator system 200. FIG. 2 is a block diagram of an embodiment of the smart elevator system 200 including an elevator car 202 with a scheduler 256 associated to the elevator car 202 that receives traffic information at 208, 210, 211, 212, and 214 from respective floor controllers, such as controllers 222, controller(s) X, 220, 218 and 216 that can act as receiving processors on various floor elevator doors. The scheduler 256 associated to the elevator car 202 is a computer implemented device that can act as a master processor, such as including a computer processor, designated to direct the at least one elevator car to a particular destination. As shown in FIG. 2, the elevator car 202, the scheduler 256 associated to the elevator car 202, a floor 1 elevator door 230, a floor 2 elevator door 228, a floor 3 elevator door 226, a floor N elevator door 224 (the floor N elevator door represents the highest floor of a floor elevator door in a structure, such as a building), a number of sensors 270, 268, 266, 264, and 203 can be associated with the smart elevator system 200, for example. FIG. 2 also shows a floor 1 elevator waiting area 246, a floor 2 elevator waiting area 244, a floor 3 elevator waiting area 242, and a floor N elevator waiting area 240 (floor N elevator waiting area represents the highest floor of a floor elevator waiting area in a structure, such as a building). The elevator waiting areas 246, 244, 242 and 240 can be similar to the elevator waiting area 100, for example.

FIG. 2 also illustrates the controller 216 associated to the floor 1 elevator door 230 that communicates with the scheduler 256 associated to the elevator car 202. The controller 216 also communicates with the controller 218 on the floor 2 directly above. The controller 218 associated to the floor 2 elevator door 228 communicates with the scheduler 256 associated to the elevator car 202. The controller 218 also communicates with a controller 220 on the floor 3 above and the controller 216 on the floor 1 below. The controller 220 associated to the floor 3 elevator door 226 communicates with the scheduler 256 associated to the elevator car 202. The controller 220 also communicates with the controller 222 on the floor N above and the controller 218 on the floor 2 below, such as where N equals 4 for a structure, such as a building, with four floors, for example. Otherwise, the controller 220 on floor 3 communicates with a controller on a floor X above the floor 3 and also with the controller 218 on the floor 2 below.

The communication among the controllers and scheduler 256 on the various floors of the structure, such as a building, continues in a similar manner through the floor N of the structure, such as a building. On the floor N, the controller 222 associated to floor N elevator door 224 communicates with the scheduler 256 associated to the elevator car 202. The controller 222 also communicates with a controller on a floor X directly below (the floor X in this case represents a floor of a floor elevator door in a structure, such as a building, directly below the floor N).

Referring to the illustration of the elevator waiting area 100 in FIG. 1B as corresponding to the floor 2 elevator waiting area 244, for example, there are four people waiting in the downward traffic area or transport zone 112 and two people waiting in the upward traffic area or transport zone 114. This traffic information relating to the number of people waiting in the downward traffic area or transport zone 112 and in the upward traffic area or transport zone 114 is transmitted at 236 by the sensor 268 to the controller 218 associated to the floor 2 elevator door 228. The controller 218 receives the traffic information, determines the passenger information based on the traffic information, and delivers the passenger information to other designated system components, such as a controller or processor.

In an embodiment of operating an elevator car in a smart elevator system, such as the smart elevator system 200 illustrated in FIG. 2, the traffic information received can be redirected by a controller, such as the controller 218, to other apparatuses, such as processors or controllers, in embodiments of a smart elevator system in various ways, for example. One such way the information can be redirected is in a multi ad-hoc sensor network. In a multi ad-hoc network the controllers are associated with each other in such a fashion such that each controller can communicate with its immediate neighboring controllers (e.g., a controller on the floor above and a controller on the floor below).

For example, the traffic information is received by the controller 218, and then the traffic information is transmitted at 250 to the controller 220 on the floor 2 above and also transmitted at 248 to the controller 216 on the floor 1 below. Also, for example, traffic information received by a controller on a floor X and is transmitted at 252 to the controller 220, where the floor X is located above the floor 3. Also, for example, traffic information received by the controller 222 on the floor N is transmitted at 254 to the controller on the floor X where the floor X is located below the floor N.

In FIG. 2, for example, the ad-hoc transmission of floor traffic information from one controller to another controller across the various floors is represented by F for the floor and the numeric value for the appropriate floor, such as the transmission of the floor traffic information at 250 from controller 218 to controller 220 is represented respectively as <F2, F3> for floors 2 and 3 and the transmission of floor traffic information at 248 from controller 218 to controller 216 is represented by as <F1, F2> for floors 1 and 2. Also, for example, the ad-hoc transmission of floor traffic information from a controller on a floor X to another controller on a floor N where for example, floor X is located directly below the floor N, is represented respectively by <FX, FN>.

Also, for example, in an embodiment of the smart elevator system 200 the controller 218 can also transmit the information directly and distinctly at 212, separate from the ad-hoc transmission, to the scheduler 256 associated to the elevator car 202. The scheduler 256 associated with the elevator car 202 receives the traffic information at 212 and implements a program or decision algorithm to select a transport path, such as including which direction the elevator should operate. For example, referring to the floor elevator waiting area 100 of FIG. 1B as corresponding to the floor 2 elevator waiting area 244, since there are four people waiting for downward elevator service and two people waiting for upward elevator service, a designated program's instruction can, for example, send the elevator car 202 to the floor 2 elevator waiting area 244 and instruct the elevator car 202 to proceed downward based on a decision logic, such as 4>2.

Figure 3:
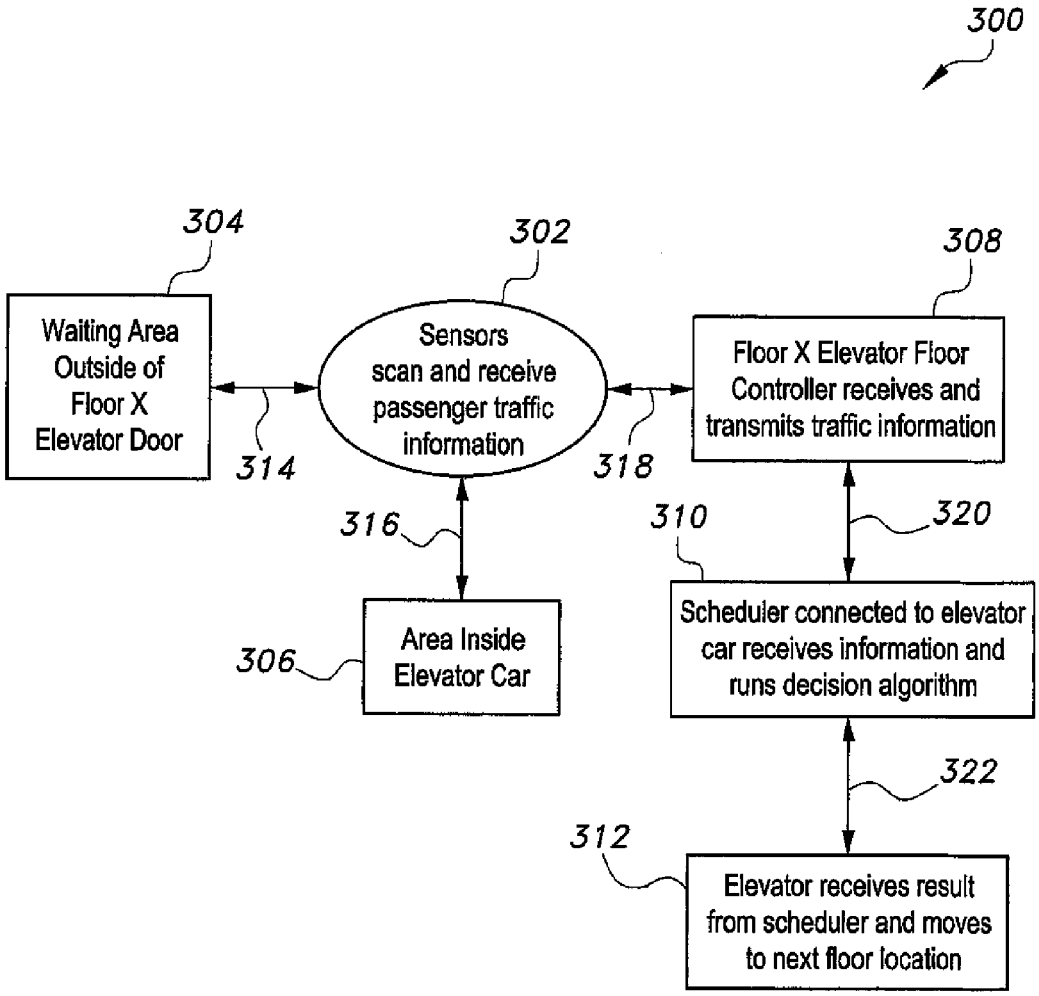
FIG. 3 is a logic diagram illustrating an embodiment of a method for operating an elevator system according to the present invention.

FIG. 3 is logic diagram that illustrates an embodiment of a method for operating an elevator system, such as the smart elevator system 200 of FIG. 2. Referring to FIG. 3, the sensors, such as the sensors 264, 266, 268 and 270, at 302 scan and receive traffic information at 314 from an elevator waiting area at 304 outside of a floor X, such as elevator waiting areas 240, 242, 244 and 246 at 304. The sensors, such as sensor 202, at 302 can also be used to scan and receive traffic information on the inner area inside of an elevator car, such as elevator car 202, at 306 to detect the number of current passengers inside an elevator car, such as elevator car 202. Once the sensors at 302 scan the elevator waiting area at 304 and the inner area inside the elevator car at 306 receive at 314 and at 316 the traffic information, the traffic information is transmitted at 318 to the floor X elevator floor controller at 308, such as the controllers 216, 218, 220 and 222, or in the case of the sensor 203 the information from the sensor 203 can also be transmitted to the scheduler 256, for example.

The floor X elevator door controller at 308 determines the passenger information from the traffic information and sends passenger information at 320 to the scheduler at 310, such as the scheduler 256, which is associated to the elevator car, such as the elevator car 202. The scheduler, such as the scheduler 256, e.g., a computer implemented device, that is associated to the elevator car, such as associated to the elevator car 202, at 310, acts as a computer processor and implements a decision program, such as implementing an algorithm, to select the elevator path or transport path, such as for the elevator car 202. The scheduler, such as the scheduler 256, that is associated to the elevator car at 310 transmits the decision and instruction at 322 as to the determined elevator path or transport path to the elevator, such as elevator car 202, at 312, such as to the elevator car's operational controller or processor to move the elevator car to a next floor location, for example.

Figure 7:
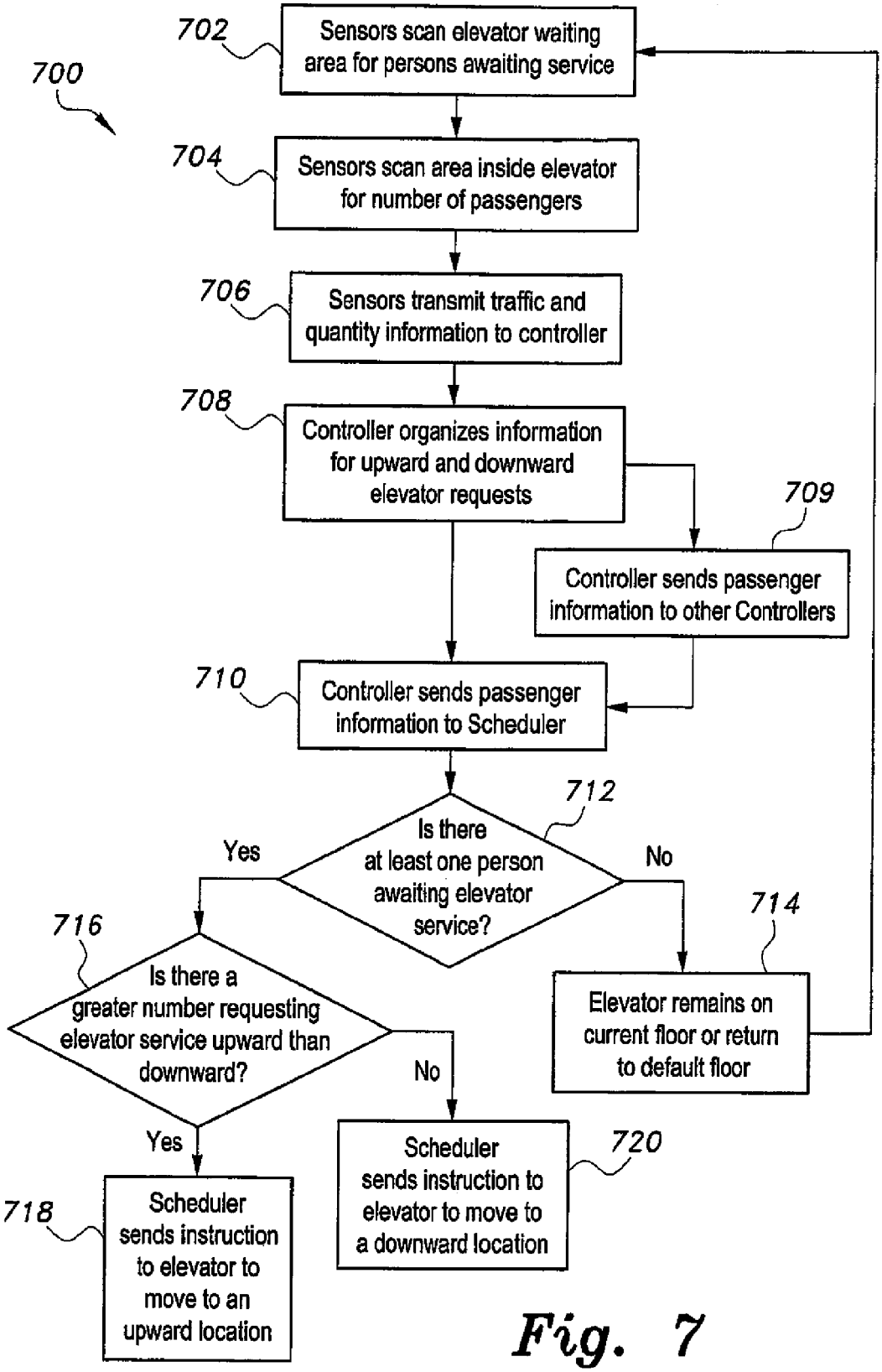
FIG. 7 is a flowchart of an embodiment illustrating a method for operating an elevator car in an elevator system according to the present invention.

Referring now to FIG. 7, a flowchart of a logic tree 700 of an embodiment of a method for operating an elevator car in an elevator system, such as the smart elevator system 200 of FIG. 2, is illustrated and described schematically. In the flowchart of the logic tree 700, the elevator waiting area 100, such as illustrated and described with respect to FIG. 1A, FIG. 1B and FIG. 1C, can also be used as an example of typical elevator waiting area, such as the floor 3 elevator waiting area 242, for purposes of illustration of an elevator system using sensors to select an elevator path or transport path for at least one elevator car, such as the elevator car 202, in FIG. 2. While in FIG. 7, an embodiment of a method for operating an elevator car in an elevator system is described with respect to the smart elevator system 200 in relation to the floor 3 elevator waiting area 242, the sensor 266, the floor controller 220 and the elevator door 226, the embodiment of the method can also be similarly described in relation to the controllers X, 222, 218 and 216, the sensors 264, 268 and 270, the elevator waiting areas 240, 244 and 246 and the floor elevator doors 230, 228 and 224.

In FIG. 7, at step 702, the sensor 266 scans the floor 3 elevator waiting area 242 outside of the floor 3 elevator door 226. In this example, the sensor 266 detects there are four people waiting in the downward traffic area or transport zone 112 and two people waiting in the upward traffic area or transport zone 114 in the elevator waiting area 242 of FIG. 2. The sensor 203 inside the elevator car 202 can scan the inner area 158 inside of the elevator car 202 at step 704, to detect whether the elevator car is full or to detect a number of persons inside the elevator car, and transmits the information to a controller, such as the controller 220, and can transmit the information also to another controller or processor, such as the scheduler 256, as can depend on the location of the elevator car, for example, at step 706. Also, the sensor 266 transmits the traffic information corresponding to the number persons detected at step 706 to the controller 220 associated to the floor 3 elevator door 226. The controller 220 associated to the floor 3 elevator door 226 receives the traffic information and organizes the passenger information for the upward and downward requests at step 708.

At step 709 the controller 220 sends the passenger information to other controllers, such as controllers 222 and 218, in an ad hoc manner. The controller 220 associated to the floor 3 elevator door 226 also sends the passenger information at 211 directly to the scheduler 256 associated to the elevator car 202 at step 710. The scheduler 256 associated to the elevator car 202 can implement a decision program at step 712 in the program or process to determine the elevator car's 202 transport path.

At step 712, the scheduler 256 associated to the elevator car 202 can compare the number of people (a total of six people in this example) awaiting elevator service in the floor 3 elevator waiting area 242 in the traffic information against a value of at least one person awaiting elevator service, for example. If it is determined at step 712 that there is at least one person awaiting elevator service, the scheduler 256 associated to the elevator car 202 proceeds to step 716 and, if not, the process proceeds to step 714 where the elevator car 202 remains on a current floor or returns to a default floor as the determined transport path. From step 714, the process returns to step 702.

Continuing at step 716 the scheduler 256 determines whether the number of persons awaiting elevator service in the floor 3 elevator waiting area 242 is greater in a downward direction or an upward direction from the floor 3, for example. In this example, since there are four persons requesting downward elevator service, greater than the two persons requesting upward elevator service, from the floor 3, the scheduler 256 associated to the elevator car 202 can proceed to step 720 and instructs, such as to the elevator car's operational controller or processor, the elevator car 202 to move in a transport path, such as a downward path to a downward location, for example. If there are a greater number of persons requesting elevator service in an upward direction from the floor 3, the scheduler 256 associated to the elevator car 202 can proceed to step 718 and instructs, such as to the elevator car's operational controller or processor, the elevator car 202 to move in a transport path, such as an upward path to an upward location, for example. Also, the transport path of the elevator car 202 can be in an upward direction, such as from the floor 2, to take the persons awaiting elevator service at the floor 3 in a downward direction, or can be in a downward direction, such as from the floor N, to take the persons awaiting elevator service at the floor 3, in a upward direction, for example.

Figure 4:
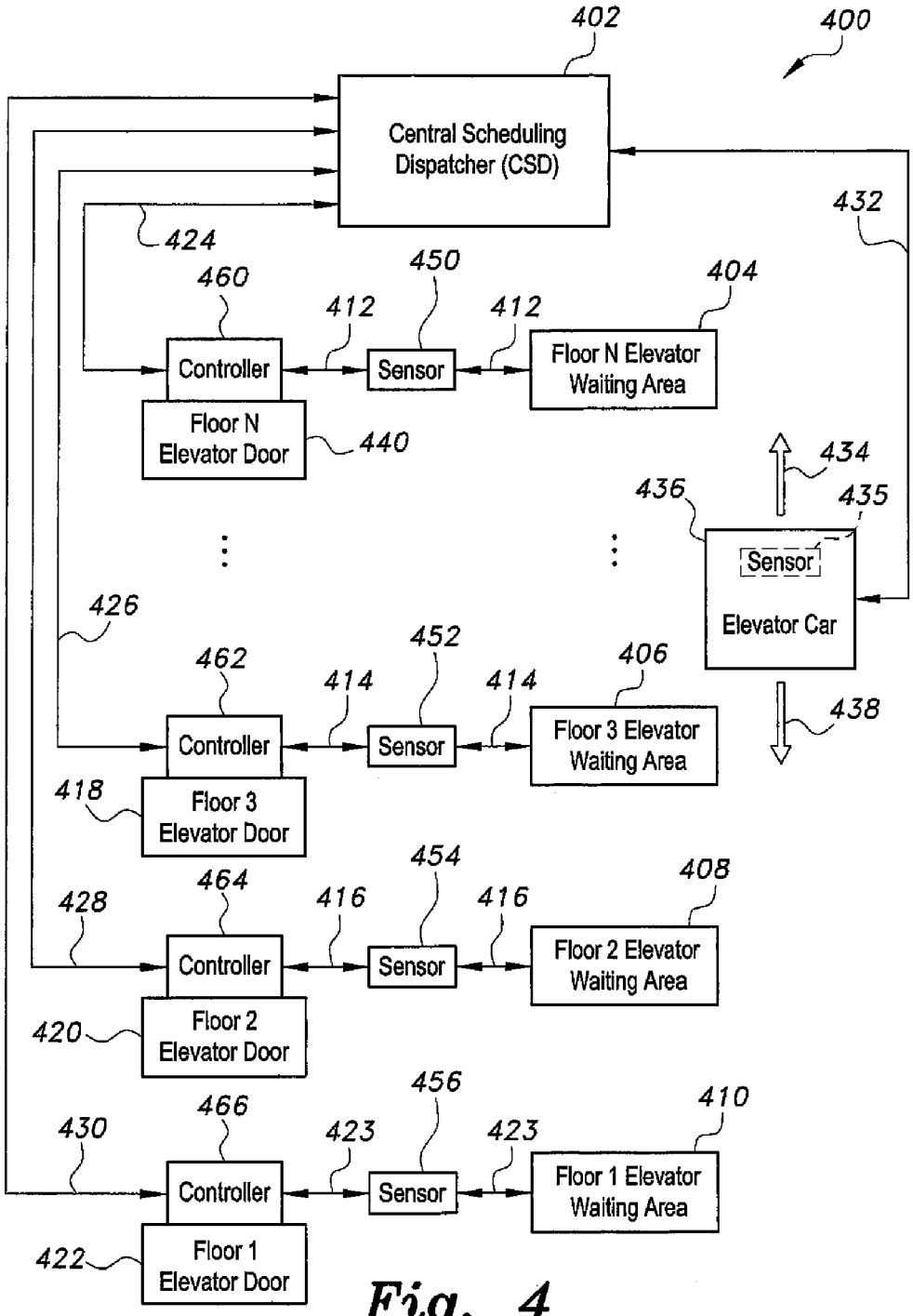
FIG. 4 is block diagram of an embodiment of a smart elevator system that includes a primary processor with bidirectional communication to various controllers and communication with an elevator and elevator car to operate the elevator's and elevator car's movement according to the present invention.

Referring to FIG. 4, there is illustrated a block diagram of an embodiment of a smart elevator system 400 that includes a primary processor with bidirectional communication to various controllers and communication to an elevator to operate the elevator's movement. In FIG. 4 the primary processor, such as a computer implemented device, is a central scheduling dispatcher 402 that can act as a master processor, with bi-directional lines of communication to floor controllers, such as controllers 460, 462, 464 and 466 as can act as receiving processors in the smart elevator system 400, the controllers being computer implemented devices, and bi-directional lines of communication to an elevator car, such as an elevator car 436, such as to an elevator car's operational controller or processor.

As shown in FIG. 4, the central scheduling dispatcher 402, the elevator car 436, a floor 1 elevator door 422, a floor 2 elevator door 420, a floor 3 elevator door 418, and a floor N elevator door 440 (the floor N elevator door represents a highest floor of a floor elevator door in a structure, such as a building), a number of sensors 450, 452, 454, 456, and 435, and a number of controllers 460, 462, 464, and 466 can be associated with the smart elevator system 400, for example. FIG. 4 also shows a floor 1 elevator waiting area 410, a floor 2 elevator waiting area 408, a floor 3 elevator waiting area 406, a floor N elevator waiting area 404 (the floor N elevator waiting area represents the highest floor of a floor elevator waiting area in a structure, such as a building). The central scheduling dispatcher 402 is a computer processor designated to implement a designated program to direct an elevator car, such as the elevator car 436, to a particular destination.

In an embodiment of the smart elevator system 400, the sensors 450, 452, 454, and 456 scan and receive at 423, 416, 414 and 412 traffic information regarding persons awaiting elevator service from the elevator waiting areas on the respective floors 1-N 410, 408, 406 and 404. The sensors 450, 452, 454 and 456 transmit the traffic data in relation to the persons awaiting elevator service at 412, 414, 416, and 423 to the corresponding controllers 460, 462, 464 and 466 associated to the corresponding floor 1-N elevator doors 418, 420, 422 and 440. The passenger traffic information is sent at 424, 426, 428 and 430 by the controllers 460, 462, 464, and 466 to the central scheduling dispatcher 402 which directs at 432 the elevator car 436 to move in a transport path, such as in an upward direction 434, or in a downward direction 438, for example. Also, the sensor 435 can be used to scan and receive traffic information on the inner area 158 inside of an elevator car, such as the elevator car 436, to detect the number of current passengers inside the elevator car, for example, and provide the information at 432 to the central scheduling dispatcher 402.

Referring to the illustration of the elevator waiting area 100 illustrated in FIG. 1A and FIG. 1B as corresponding to the floor 2 elevator waiting area 408, for example, there are four people waiting in the downward traffic area or transport zone 112 and two people waiting in the upward traffic area or transport zone 114. This traffic data is transmitted at 416 by the sensor 454 to the controller 464 associated with the floor 2 elevator door 420. The passenger data is determined by the controller 464 and transmitted at 428 to the central scheduling dispatcher 402. The central scheduling dispatcher 402 acts as a computer processor, implements a designated program to select an elevator path or transport path, and sends an instruction at 432 to the elevator car 436 with the selected instruction to move in the downward direction 438, for example, since there are more persons requesting service in the downward direction 438 than the upward direction 434.

In the smart elevator system 400 of FIG. 4, in contrast to the smart elevator system 200 of FIG. 2, the controllers 460, 462, 464 and 466 can communicate directly with a primary processor, such as the central scheduling dispatcher 402 which can act as a master processor, whereas in the smart elevator system 200 of FIG. 2 the controllers X, 222, 220, 218 and 216 typically communicate at 248, 250, 252 and 254 with other controllers X, 222, 220, 218, and 216 and also transmit the information at 208, 210, 211 212, and 214 to a processor, such as the scheduler 256 associated to the elevator car 202, for example.

Figure 5:
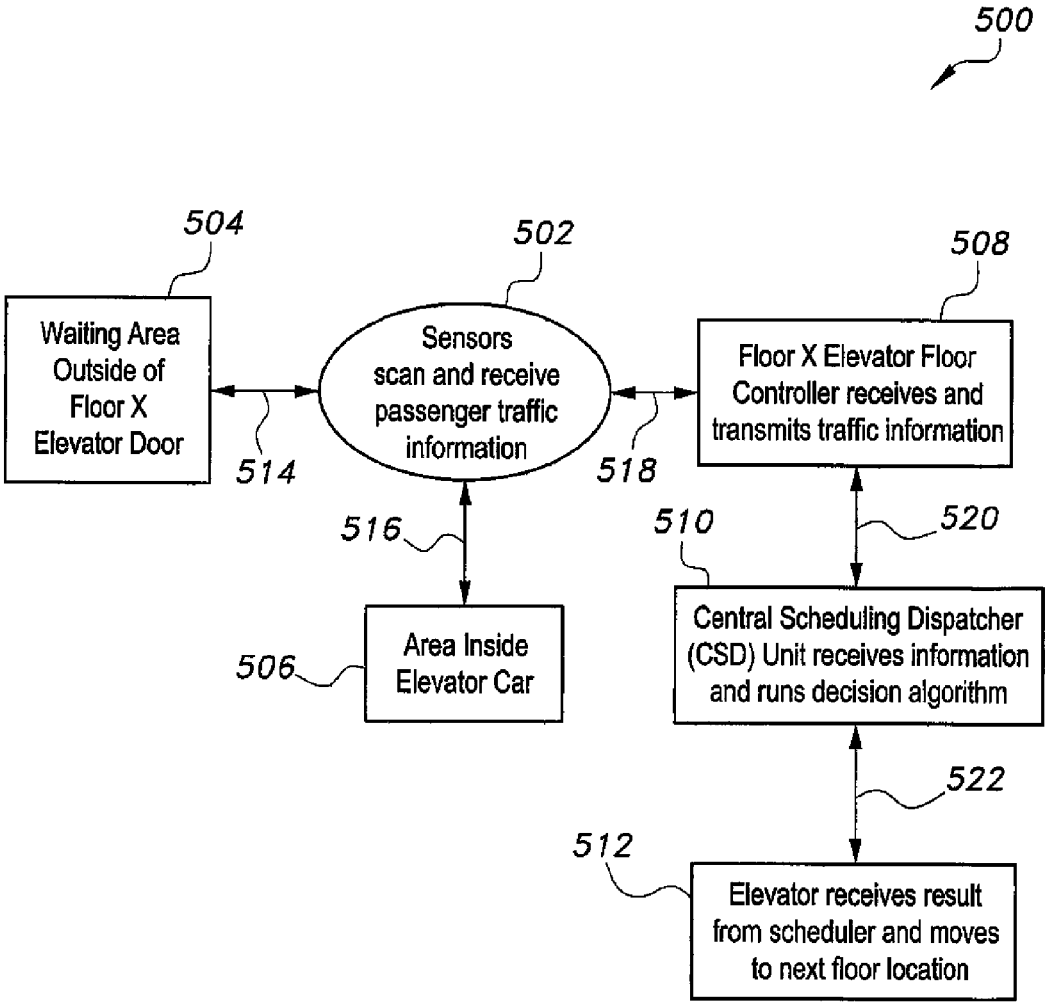
FIG. 5 is a logic diagram illustrating an embodiment of a method for operating an elevator system according to the present invention.

FIG. 5 is logic diagram that illustrates an embodiment of a method for operating an elevator system, such as the smart elevator system 400 of FIG. 4. Referring to FIG. 5, the sensors, such as sensors 450, 452, 454 and 456, at 502 scan and receive traffic information at 514 from the elevator waiting areas at 504, such as elevator waiting areas 404, 406, 408 and 410, outside of corresponding floors 1-N. The sensors, such as sensor 435, at 506 can be used to scan and receive traffic information on the inner area 158 inside of an elevator car, such as the elevator car 436 to detect the number of current passengers inside an elevator car, such as the elevator car 436. After the sensors at 502 scan the elevator waiting area at 504 and the area inside the elevator car at 506 receive at 514 and at 516 the traffic information, the traffic information is transmitted at 518 to the corresponding floor X elevator floor controller, such as controllers 460, 462, 464 and 466, at 508, or in the case of the sensor 435 the information from the sensor 435 can also be transmitted to the central scheduling dispatcher 402, for example.

The floor X elevator door controller, such as controllers 460, 462, 464 and 466, at 508 determines the passenger information based on the traffic information and then sends the passenger information at 520 to the central scheduling dispatcher, such as the central scheduling dispatcher 402, at 510. The central scheduling dispatcher, such as the central scheduling dispatcher 402, at 510 implements a decision program, such as an implementing an algorithm, to select the elevator path or transport path for the elevator car, such as the elevator car 436. The central scheduling dispatcher, such as central scheduling dispatcher 402, transmits the decision and instruction at 522 to the elevator car, such as the elevator car 436, such as to the elevator car's operational processor or controller, at 512 to move to a next floor location, for example.

Figure 8:
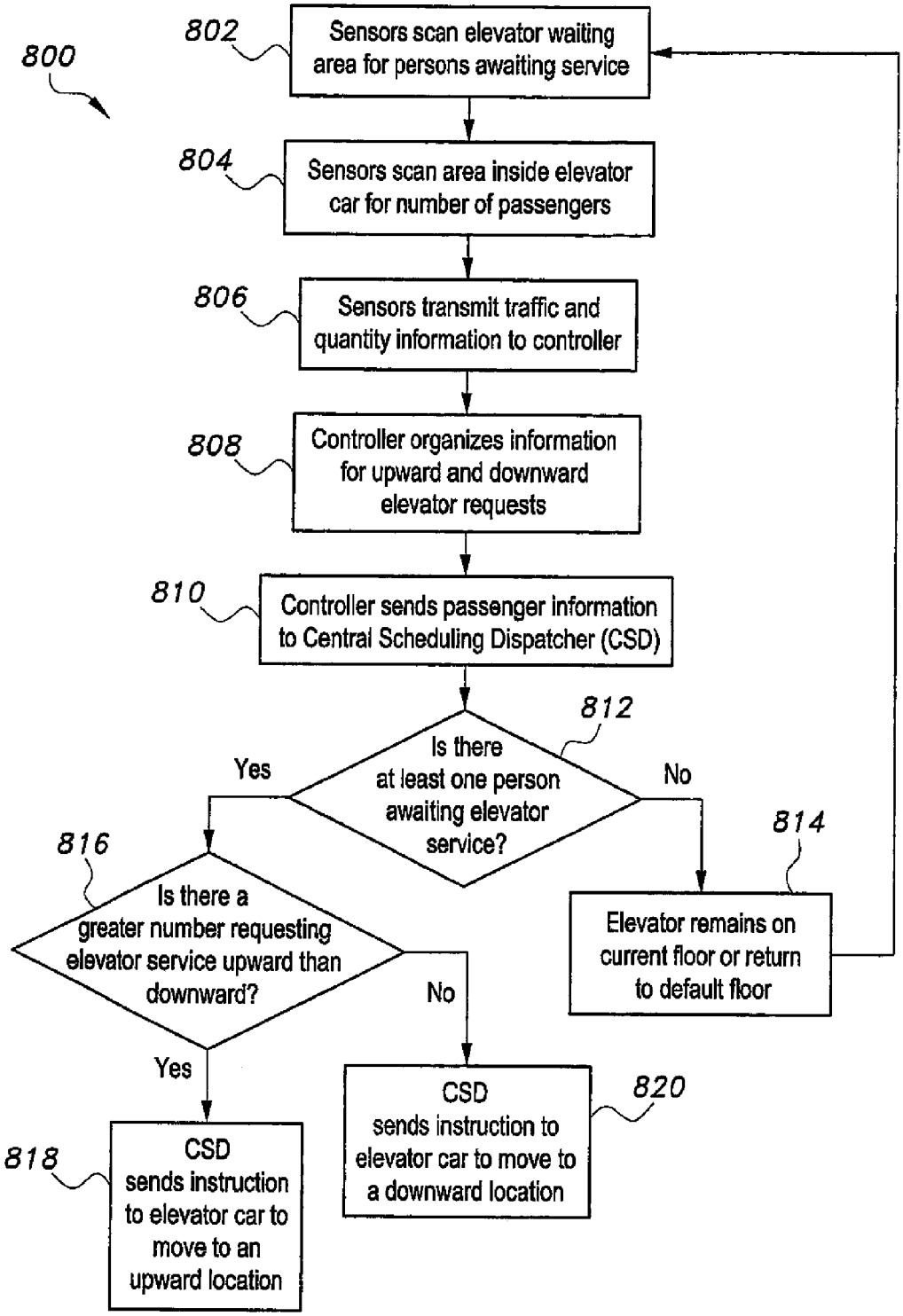
FIG. 8 is a flowchart of an embodiment illustrating a method for operating an elevator car in an elevator system according to the present invention.

Referring now to FIG. 8, a flowchart of a logic tree 800 of an embodiment of a method for operating an elevator car in an elevator system, such as the smart elevator system 400 of FIG. 4, is illustrated and described schematically. In the flowchart of the logic tree 800, the elevator waiting area 100, such as illustrated and described with respect to FIG. 1A, FIG. 1B and FIG. 1C, can also be used as an example of typical elevator waiting area, such as the floor 2 elevator waiting area 408, for purposes of illustration of an elevator system using sensors and illustrating a decision algorithm to select an elevator path or transport path for at least one elevator car, such as the elevator car 436 in FIG. 4. While in FIG. 8, an embodiment of a method for operating an elevator car in an elevator system is described with respect to the smart elevator system 400 in relation to the floor 2 elevator waiting area 408, the sensor 454, the floor controller 464 and the floor 2 elevator door 420, the embodiment of the method can also be similarly described in relation to the controllers 466, 462 and 460, the sensors 456, 452 and 450, the elevator waiting areas 410, 406 and 404 and the floor elevator doors 422, 418 and 440.

In FIG. 8, at step 802, the sensor 454 scans the elevator waiting area 408 outside of the floor 2 elevator door 420. In this example, the sensor 454 detects there are four people waiting in the downward area or transport zone 112 and five people waiting in the upward area or transport zone 114 in the floor 2 elevator waiting area 408 for FIG. 4. The sensor 435 inside the elevator car 436 can also scan the inner area 158 inside of the elevator car 436 at step 804, to detect whether the elevator car is full or to detect a number of persons inside the elevator car, and transmits the information to a processor, such as the central scheduling dispatcher 402, and the sensor 435 can transmit the information also to or through another processor, such as to or through controllers 460, 462, 464, and 466, such as can depend on the location of the elevator car, for example, at step 806.

Also, at step 806, the sensor 454 transmits at 416 the passenger information at step 806 to the controller 464 associated to the floor 2 elevator door 420. The controller 464 associated to the floor 2 elevator door 420 receives the information at 416 and determines the passenger information for the upward and downward requests at step 808. The controller 464 associated to the floor 2 elevator door 420 transmits the passenger information at 428 to the central scheduling dispatcher 402 at step 810. The central scheduling dispatcher 402 can implement a decision program at step 812 in the program or process to determine the elevator car's 436 transport path. At step 812, the central scheduling dispatcher 402 can compare the number of people (a total of nine people in this example) awaiting elevator service in the passenger information against a value of at least one person awaiting elevator service, for example. As there has been determined there is at least one person awaiting elevator service at step 812, the central scheduling dispatcher 402 proceeds to step 816. If it has been determined that there is not at least one person awaiting service, the process proceeds to step 814 where the elevator car, such as elevator car 436, remains on a current floor or returns to a default floor as the determined transport path. From step 814, the process returns to step 802.

Continuing at step 816, it is determined whether the number of persons awaiting elevator service is greater in the downward direction 438 or in the upward direction 434, for example. In this example there are five people waiting for elevator service in the upward direction 434 so the central scheduling dispatcher 402 proceeds to step 818 and instructs the elevator car 436, such as to the elevator car's operational controller or processor, to move in an upward path, for example, as the transport path. If there are a greater number of people requesting elevator service in the downward direction 438, the central scheduling dispatcher 402 can proceed to step 820 and instructs the elevator car 436, such as to the elevator car's operational controller or processor, to move to in a downward path, for example, as the transport path. Also, the transport path of the elevator car 436 can be upward, such as from the floor 1, to take the persons awaiting elevator service in a downward direction waiting at the floor 2, or can be downward, such as from the floor N, to take the persons awaiting elevator service at the floor 2, in a upward direction, for example.

Figure 6A:
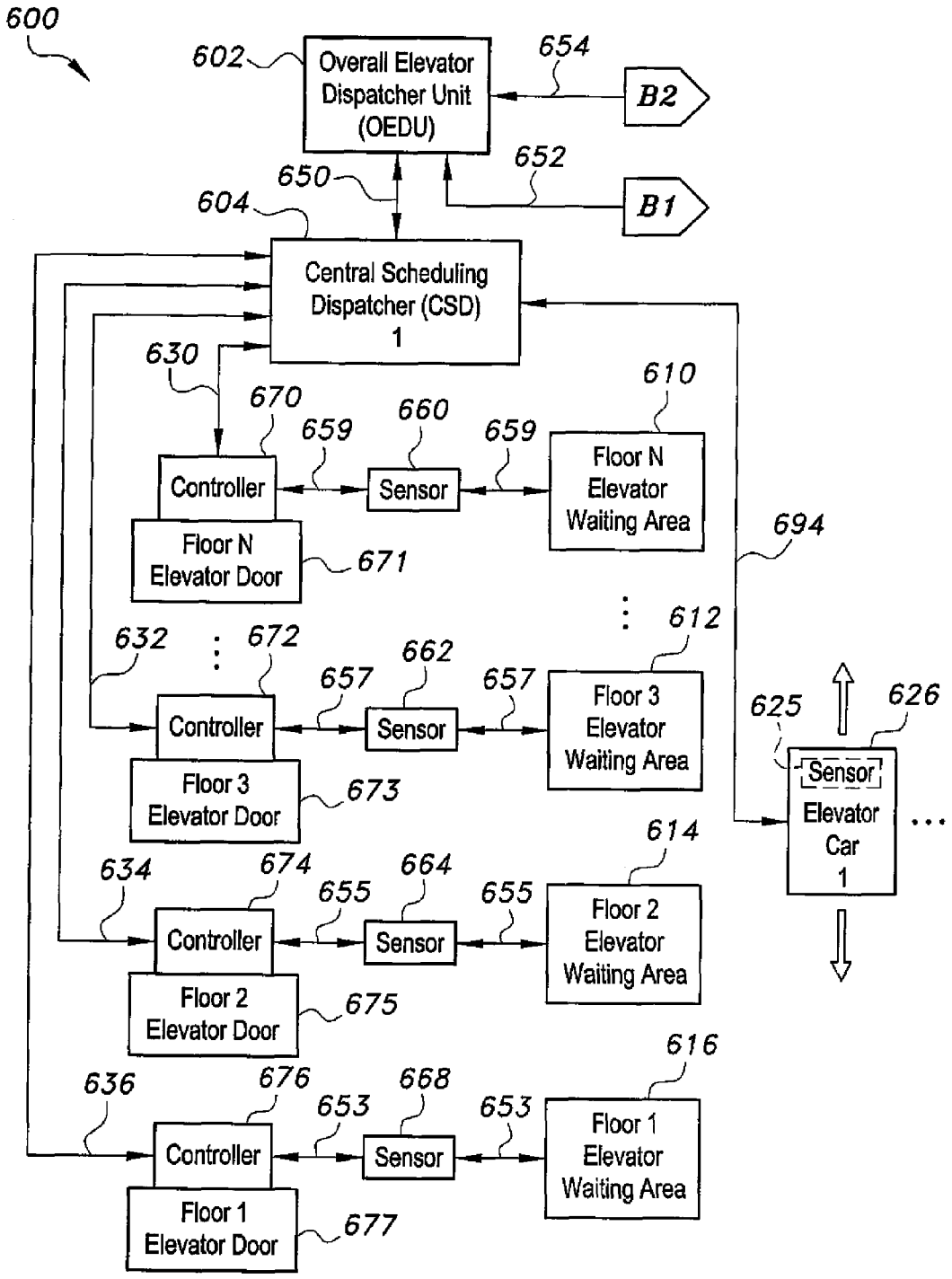
FIG. 6A and FIG. 6B together illustrate a block diagram of an embodiment of a method for operating an elevator system having a plurality of elevators and elevator cars according to the present invention.
Figure 6B:
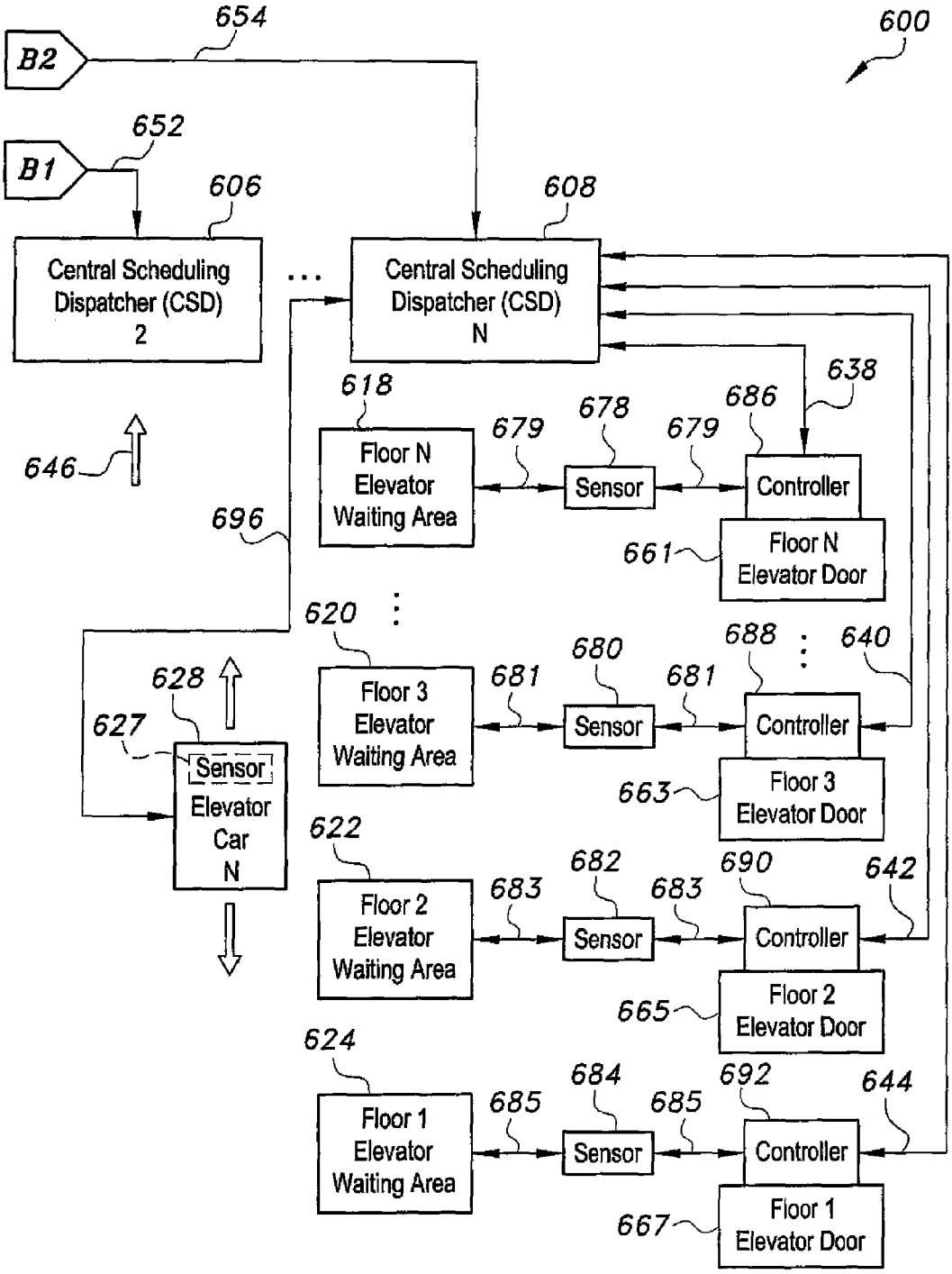

FIG. 6A and FIG. 6B together illustrate a block diagram of an embodiment of a method for operating a smart elevator system 600 having a multitude of elevators and elevator cars. In FIG. 6A and FIG. 6B there is illustrated an overall elevator dispatcher unit 602, a central scheduling dispatcher 1 604, a central scheduling dispatcher 2 606, and a central scheduling dispatcher N 608 (N represents a highest number central scheduling dispatcher of a total of N central scheduling dispatchers of a smart elevator system) associated with the smart elevator system 600, for example. The overall elevator dispatcher unit 602, such as a computer implemented device, acts as a primary computer processor and can act as a master processor or a central master processor, in the smart elevator system 600. Each central scheduling dispatcher 604, 606 and 608, such as a computer implemented device, can act as an intermediate, secondary or receiving processor, or can act a master processor that communicates with a central master processor, for communication to a corresponding group of controllers, such as controllers corresponding to an elevator car.

FIG. 6A shows the overall elevator dispatcher unit 602, the central scheduling dispatcher 1 604, a plurality of floor controllers, such as controllers 670, 672, 674 and 676, floor 1-N elevator doors 671, 673, 675 and 677, a plurality of sensors 660, 662, 664, 668 and 625, floor 1-N elevator waiting areas 610, 612, 614 and 616, and an elevator car 1 626 associated with the smart elevator system 600, for example. The sensors 660, 662, 664 and 668 on floors 1-N scan and transmit at 659, 657, 655 and 653 the passenger traffic information received from corresponding floor 1-N elevator waiting areas 610, 612, 614 and 616 to the corresponding controllers 670, 672, 674 and 676, e.g., computer processors, that can act as receiving processors. The sensors, such as sensor 625, can be used to scan and receive traffic information on the inner area 158 inside of an elevator car, such as the elevator car 1 626 to detect the number of current passengers inside an elevator car, such as the elevator car 1 626. After the sensor 625 scans the inner area 158 of the elevator car 1 626, the information from the sensor 625 can be transmitted to a controller or processor, such as the central scheduling dispatcher 1 604, as can act as a receiving processor, for example.

The floor controllers 670, 672, 674 and 676 transmit at 630, 632, 634 and 636 the passenger traffic information to the central scheduling dispatcher 1 604. The central scheduling dispatcher 1 604 can organize and determine passengers' downward and upward elevator requests based on the traffic information received at 630, 632, 634 and 636 from the corresponding floor controllers 670, 672, 674 and 676. The central scheduling dispatcher 1 604 then sends the determined passenger information at 650 to the overall elevator dispatcher unit 602. The overall elevator dispatcher unit 602 receives passenger information at 650 from at least the central scheduling dispatcher 1 604, implements a decision program to select at least one transport path for at least one elevator car, such as the elevator car 1 626, and returns the selected transport path at 650 to the central scheduling dispatcher 1 604. The central scheduling dispatcher 1 604 can then transmit at 694 the selected transport path to the corresponding elevator car 1 626, such as to the elevator car's operational controller or processor, for example.

FIG. 6B also shows the central scheduling dispatcher 2 606, the central scheduling dispatcher N 608, a plurality of floor controllers, such as controllers 686, 688, 690 and 692, floor 1-N elevator doors 661, 663, 665 and 667, a plurality of sensors 678, 680, 682, 684 and 627 and floor 1-N elevator waiting areas 618, 620, 622, and 624, and an elevator car N 628 associated with the smart elevator system 600, for example. The sensors 684, 682, 680 and 678 on floors 1-N scan and transmit at 685, 683, 681 and 679 the passenger traffic information received from corresponding floor 1-N elevator waiting areas 624, 622, 620 and 618 to the corresponding controllers 692, 690, 688 and 686, e.g., computer processors, that can act as receiving processors. The sensors, such as sensor 627, can be used to scan and receive traffic information on the inner area 158 inside of an elevator car, such as the elevator car N 628 to detect the number of current passengers inside an elevator car, such as the elevator car N 628. After the sensor 627 scans the inner area 158 of the elevator car N 628, the information from the sensor 627 can be transmitted to a controller or processor, such as the central scheduling dispatcher N 608, as can act as a receiving processor, for example.

Also, similarly, associated with the central scheduling dispatcher 2 606 are a plurality of floor controllers, floor 1-N elevator doors, a plurality of sensors, and floor 1-N elevator waiting areas and an elevator car 2, similar to those associated with the central scheduling dispatcher 1 604 or the central scheduling dispatcher N in the smart elevator system 600, for example. The sensors associated with the central scheduling dispatcher 2 606 on floors 1-N respectively scan and transmit the passenger traffic information received from corresponding floor 1-N elevator waiting areas to the corresponding floor controllers, e.g., computer processors, which can act as receiving processors. The sensors, such as at least one sensor, can be used to scan and receive traffic information on the inner area 158 inside of an elevator car, such as the elevator car 2 to detect the number of current passengers inside an elevator car, such as the elevator car 2. After the at least one sensor scans the inner area 158 of the elevator car 2, the information from the sensor can be transmitted to a controller or processor, such as the central scheduling dispatcher 2 606, as can act as a receiving processor, for example.

The central scheduling dispatcher N 608, as well as the central scheduling dispatcher 2 606, receives and communicates information analogous to the system described with respect to the central scheduling dispatcher 1 604. However, the central scheduling dispatcher N 608 communicates at 638, 640, 642, and 644 with floor controllers 686, 688, 690 and 692, and sends the selected transport path instruction at 696 to its corresponding elevator car N 628, such as to the elevator car's operational controller or processor. Also, the overall elevator dispatcher unit 602 receives passenger information at 654 from the central scheduling dispatcher N 608, implements a decision program to select at least one transport path for at least one elevator car, such as the elevator car N 628, and returns the selected transport path at 654 to the central scheduling dispatcher N 608. The central scheduling dispatcher N 608 can then transmit at 696 the selected transport path to the corresponding elevator car N 628, such as to the elevator car's operational controller or processor, for example.

Further, the central scheduling dispatcher 2 606 communicates with its associated corresponding floor controllers and sends the selected transport path instruction to a corresponding elevator car 2, for example. Also, the overall elevator dispatcher unit 602 receives passenger information at 652 from the central scheduling dispatcher 2 606, implements a decision program to select at least one transport path for at least one elevator car, such as an elevator car 2 associated with the central scheduling dispatcher 2 606, and returns the selected transport path at 652 to the central scheduling dispatcher 2 606, for example. The central scheduling dispatcher 2 606 can then transmit the selected transport path to the corresponding elevator car 2, such as to the elevator car's operational controller or processor, for example.

In an embodiment of the smart elevator system 600, the overall elevator dispatcher unit 602 can act as the primary scheduling dispatcher unit instead of a central scheduling dispatcher, in contrast to the central scheduling dispatcher 402 being a primary scheduling dispatcher in the smart elevator system 400 of FIG. 4, for example. However, each central scheduling dispatcher 604, 606 and 608 in the smart elevator system 600 operates in the smart elevator 600 analogous and similar to the operation of the central scheduling dispatcher 402 of the smart elevator system 400 of FIG. 4, as discussed, other than acting as a primary scheduling dispatcher unit, for example. In this regard, in the smart elevator system 600, the overall elevator dispatcher unit 602 acts as the primary computer processor which implements the decision program, such as to implement an algorithm, and sends instructions at 650, 652 and 654, to the central scheduling dispatchers 604, 606 and 608 for the operation, such as at 694 and at 696, for the elevator cars in the smart elevator system, such as elevator cars 626 and 628, for example.

Also, the overall elevator dispatcher unit 602 in the smart elevator system 600 can send instructions to and receive information from one or more of a plurality of central scheduling dispatchers, the communications can be sent to or received from the one or more central scheduling dispatchers, such as central scheduling dispatchers 604, 606 and 608, simultaneously, at about a same time, at different times or independently of the other central scheduling dispatchers, for example. Also, the instructions sent for the operation of the elevator cars in the smart elevator system 600 can be sent simultaneously, at about a same time, at different times or independently as to operation of or a transport path for each corresponding elevator car, for example.

Figure 9A:
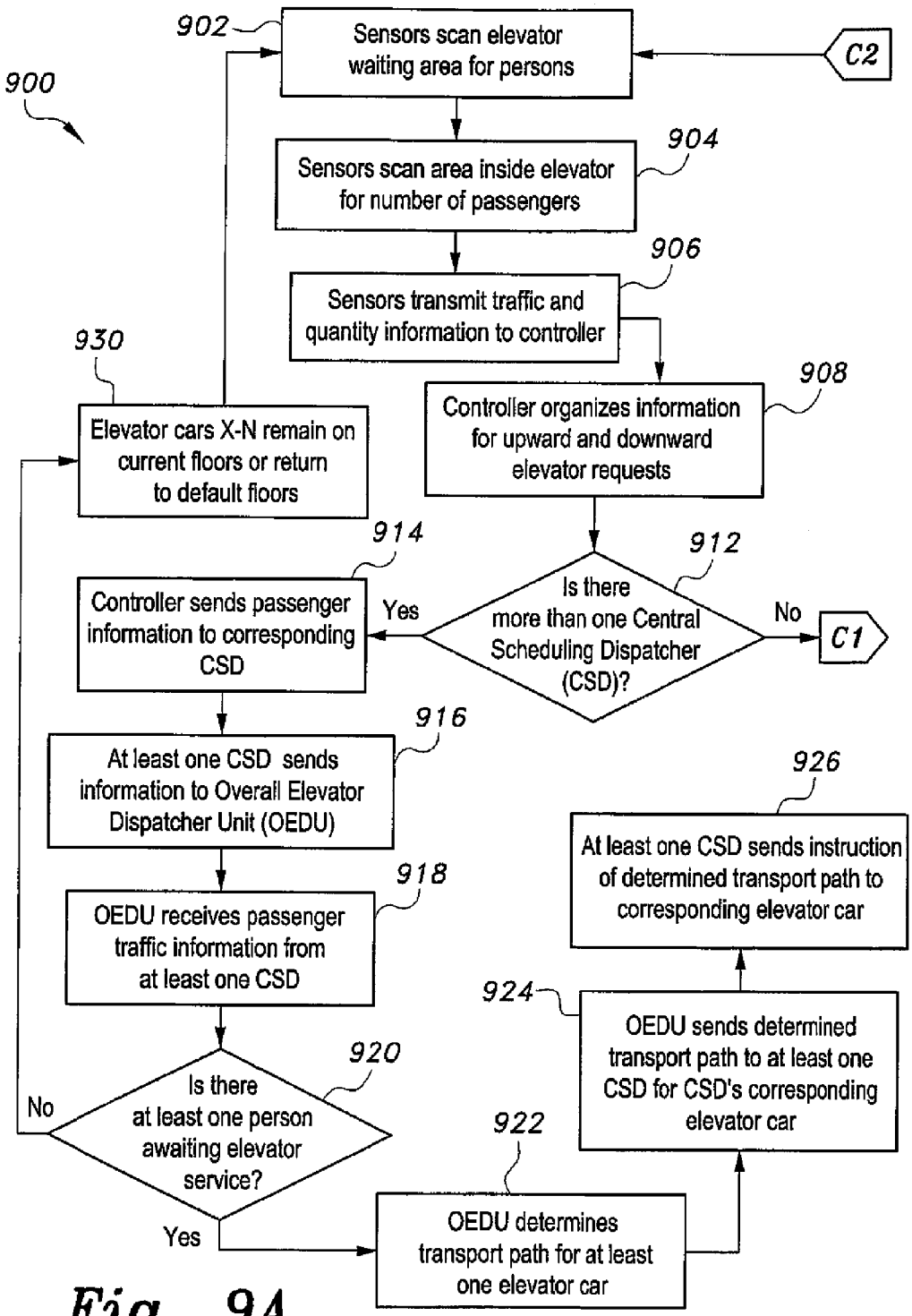
FIG. 9A and FIG. 9B together illustrate a flowchart of an embodiment of a method for operating a plurality of elevator cars in an elevator system according to the present invention.
Figure 9B:
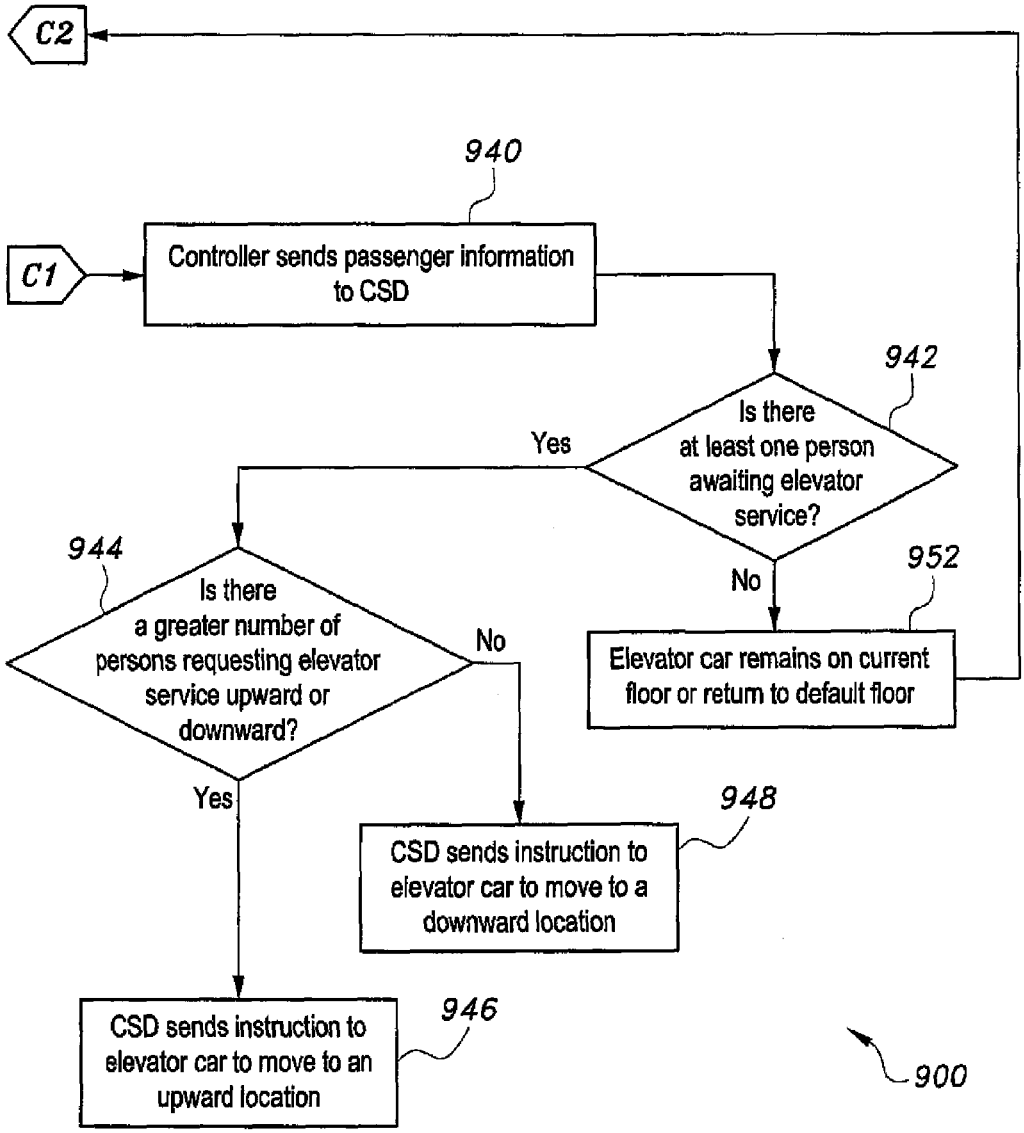

Referring now to FIG. 9A and FIG. 9B, in combination, a flowchart of a logic tree 900 of an embodiment of a method for operating a plurality of elevator cars in an elevator system, such as the smart elevator system 600 of FIG. 6A and FIG. 6B, is illustrated and described schematically. The logic tree 900 shows the process for a primary processor, such as a computer implemented device, e.g. the overall elevator dispatcher unit 602, directing a plurality of elevator cars, such as elevator cars 626 and 628, for example.

While in FIG. 9A and FIG. 9B, an embodiment of a method for operating an elevator car in an elevator system is described with respect to the smart elevator system 600 and the central scheduling dispatcher 1 604 in relation to the floor 2 elevator waiting area 614, the sensor 664 and the sensor 625, the floor controller 674, the floor 2 elevator door 675 and the elevator car 1 626, the embodiment of the method can also be similarly described in relation to the controllers 676, 672 and 670, the sensors 668, 662 and 660, the elevator waiting areas 616, 612 and 610 and the floor elevator doors 677, 673 and 671 associated with the central scheduling dispatcher 1-604.

Also, the embodiment of a method for operating an elevator car in an elevator system described with respect to the smart elevator system 600 and the central scheduling dispatcher 1 604 in FIG. 9A and FIG. 9B can also be similarly described in relation to the central scheduling dispatcher 2 606 and the central scheduling dispatcher N 608 and the corresponding controllers, sensors, elevator waiting areas, floor elevator doors and elevator cars respectively associated with the central scheduling dispatcher 2 606 and the central scheduling dispatcher N 608.

At step 902, at least one sensor, such as sensor 664, scans the elevator waiting area outside of at least one floor elevator door, such as floor 2 elevator waiting area 614, the elevator waiting area 614 being similar to the elevator waiting area 100 of FIG. 1A, FIGS. 1B and 1C, for example, with reference also being made to the elevator waiting area 100 in the description of FIG. 9A and FIG. 9B. At least one sensor, e.g. sensor 625, can also scan the inside area, e.g. the inner area 158, of the elevator car, e.g. elevator car 626, at step 904 to detect whether the elevator car is full or to detect a number of persons inside the elevator car, and can transmit the information to a controller or processor, such as the central scheduling dispatcher 1 604, at step 906, which information can also be provided to or through one or more other controllers, such as the overall elevator dispatcher unit 602 or the central scheduling dispatcher 1 604, and corresponding information, e.g., the available capacity or current capacity of the elevator car 626, can be provided, such as for display on the display 109, for example.

Also, after the at least one sensor, such as the sensor 664, scans and receives the traffic information of persons awaiting elevator service, such as the number of persons waiting in the downward traffic area or transport zone 112 and the number of persons waiting in the upward traffic area or transport zone 114, the at least one sensor transmits the traffic information to at least one controller, such as controller 674, associated with an elevator car, such as the elevator car 626, at step 906. Once the at least one controller receives the traffic information from the corresponding sensors, the at least one controller can organize the information for upward and downward elevator requests at step 908.

At step 912, it is determined whether there is more than one central scheduling dispatcher. If there is not more than one central scheduling dispatcher at step 912, such as where other of a plurality of central scheduling dispatchers in the smart elevator system 600 are not currently active or where there is only a single central scheduling dispatcher in a structure, such as a building, that is associated with an overall elevator dispatcher unit, for example, the process proceeds to step 940. At step 940, the at least one controller can send the passenger information to the corresponding central scheduling dispatcher, such as central scheduling dispatcher 1 604, at step 940. The process then proceeds to step 942 where the central scheduling dispatcher, such as central scheduling dispatcher 1 604, can compare the number of people awaiting elevator service in the passenger information against a value of at least one person awaiting elevator service, for example. If it is determined at step 942 that there is not at least one person awaiting elevator service, the elevator car remains on the current floor or returns to the default floor at step 952, as the determined transport path, and the process can return to step 902.

However, where it was determined at step 912 that there is not more than one central scheduling dispatcher, if it is determined that there is at least one person awaiting elevator service at step 942, the central scheduling dispatcher, such as the central scheduling dispatcher 1 604, proceeds to step 944 to determine whether the number of people awaiting elevator service is greater in a downward direction or an upward direction, for example. At step 944, if the number of persons awaiting elevator service is greater in an upward direction, the process proceeds to step 946, and the central scheduling dispatcher, such as central scheduling dispatcher 1 604, can direct the elevator car, such as the elevator car 626, such as to the elevator car's operational controller or processor, to proceed on a transport path in an upward direction at step 946, for example.

However, if at step 944 it is determined that the number of persons awaiting elevator service is greater in a downward direction, the process proceeds to step 948, and the central scheduling dispatcher, such as central scheduling dispatcher 1 604, can direct the elevator car, such as the elevator car 626, such as to the elevator car's operational controller or processor, to proceed on a transport path in a downward direction at step 948, for example. Also, the transport path of the elevator car 626 can be upward, such as from the floor 2, to take the persons awaiting elevator service in a downward direction waiting at the floor 3, or can be downward, such as from the floor N, to take the persons awaiting elevator service at the floor 3, in an upward direction, for example.

Continuing with reference to step 912, if it is determined there is more than one central scheduling dispatcher in the smart elevator system 600 at step 912, the process proceeds to step 914. At step 914, the at least one controller, such as the controllers 670, 672, 674 and 676 or the controllers 686, 688, 690 and 692, sends the passenger information to the at least one corresponding central scheduling dispatcher, such as the corresponding central scheduling dispatcher 604, 606 or 608. The process proceeds to step 916, where the passenger information is then passed by the at least one corresponding central scheduling dispatcher to the primary processor, such as a computer implemented device, e.g. the overall elevator dispatcher unit (OEDU) 602.

At step 918, the overall elevator dispatcher unit, such as the overall elevator dispatcher unit 602, receives passenger traffic information from one or more central scheduling dispatchers, such as the central scheduling dispatchers 604, 606 and 608. Upon receipt of all the passenger traffic information, the overall elevator dispatcher unit 602 can compare the number of people awaiting elevator service in the passenger information against a value of at least one person awaiting elevator service, for example, at step 920. If it is determined that there is not at least one person awaiting elevator service at step 920, the process proceeds to step 930 where the corresponding elevator cars remain on the current floors or return to the default floors, as the determined transport path, and the process then proceeds to return to step 902.

If there is at least one person awaiting elevator service at step 920, the process proceeds to step 922 where the overall elevator dispatcher unit, such as the overall elevator dispatcher unit 602, determines the transport path for at least one elevator car of a group of elevator cars and determines from the group of elevator cars, at least one elevator car of a total number of, or of a plurality of, elevator cars to service an elevator floor or floors for the person or persons awaiting elevator service at step 922. Based on the determination, at step 924, the overall elevator dispatcher unit, such as the overall elevator dispatcher unit 602, sends the one or more determined transport paths for the one or more elevator cars of the group of elevator cars to the corresponding central scheduling dispatchers, such as the central scheduling dispatcher 1 604, the central scheduling dispatcher 2 606 through the central scheduling dispatcher N 608, of a group of central scheduling dispatchers.

Based on the received determined one or more transport paths, the process proceeds to step 926 where at least one of the central scheduling dispatchers, such as at least one of the central scheduling dispatchers 1 604 through N 608, sends instructions for a corresponding determined transport path, such as can include an upward transport path, a downward transport path, or a combination thereof, to a corresponding elevator car, such as to the elevator car's operational controller or processor. Also, the transport path of an elevator car can be upward, such as from the floor 2, to take the persons awaiting elevator service in a downward direction waiting at the floor 3, or can be downward, such as from the floor N, to take the persons awaiting elevator service at the floor 3, in an upward direction, for example.

Further, it will be appreciated that embodiments of smart elevator systems and embodiments of methods for operating smart elevator systems can be implemented by one or more computer implemented devices, such as for the various controllers or processors of a smart elevator system, in which the instructions for operating the smart elevator system can be stored in a memory of and implemented by the computer implemented device, such as a processor, computer or computer server, for example. In such embodiments, the one or more computer implemented devices and one or more implementing computer applications includes hardware, such as can include processors and memory, and software for adapting and implementing the operation of embodiments of smart elevator systems and methods for operating smart elevator systems, such as by computer architecture and schematic processes, as described, such as in in relation to the smart elevator systems 200, 400 and 600 of FIG. 2, FIG. 4, FIG. 6A and FIG. 6B as methods for operating the smart elevator systems 200, 400 and 600 as in relation to FIG. 3, FIG. 5 and FIGS. 7-9B, for example.

Figure 10:
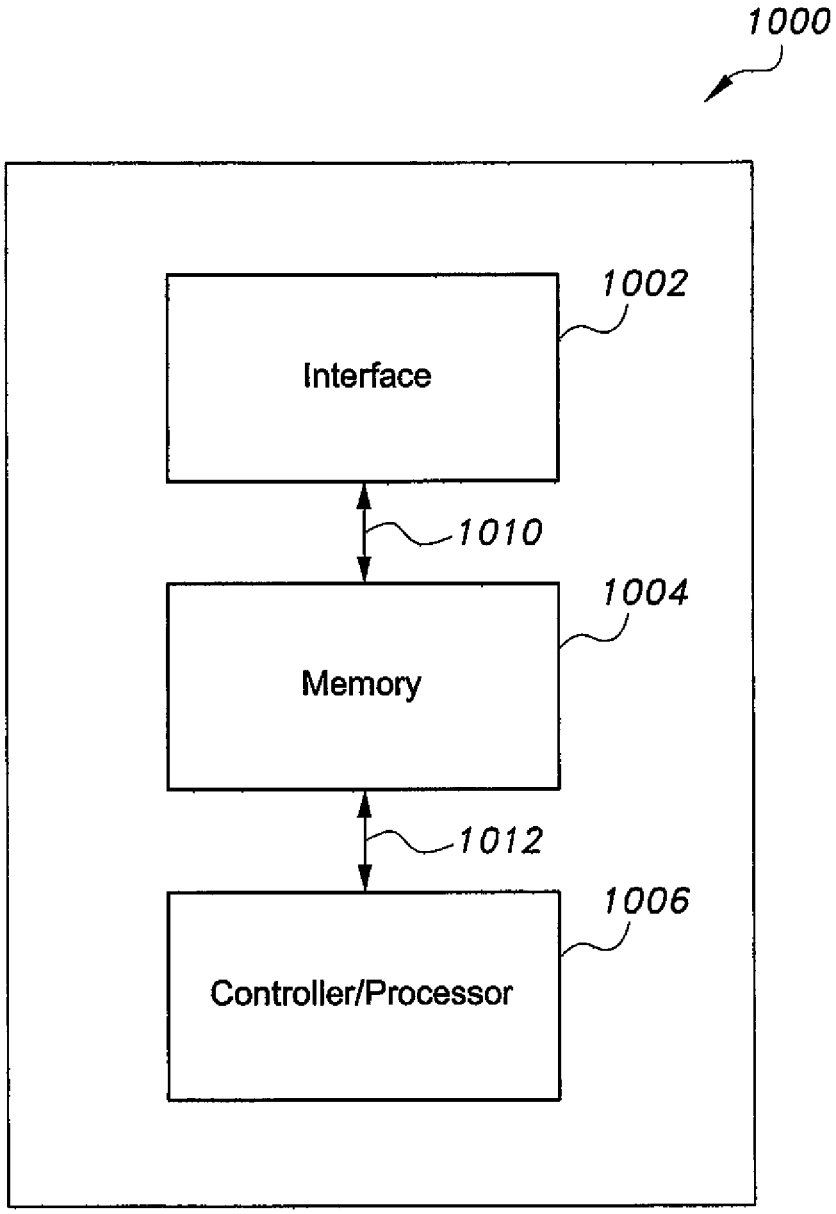
FIG. 10 is a block diagram illustrating an embodiment of a general control system in a smart elevator system and in methods for operating a smart elevator system according to the present invention.

FIG. 10 illustrates a generalized system 1000, such as or can be included in a computer implemented device, as can be used for implementing embodiments of smart elevator systems and embodiments of methods for operating elevator systems, such as the processors, controllers, central scheduling dispatchers and overall elevator dispatcher units, for example. Also, it should be understood that the generalized system 1000 can represent, for example, a processor, a controller, a stand-alone computer, a computer terminal, networked or computer terminal or a networked portable device, for example.

In FIG. 10, the generalized system 1000 includes an interface 1002, a memory 1004, and a controller/processor 1006, for example. Information, such as traffic information from the sensors, can be acquired by the interface 1002 through the network of the smart elevator system and stored at 1010 in the memory 1004, such as a computer readable memory, which can be any suitable type of computer readable and programmable memory.

Examples of computer readable media as can be used or included in the memory 1004 can include a non-transitory computer readable storage memory, a magnetic recording apparatus, an optical disk, a magneto-optical disk, and/or a semiconductor memory (for example, RAM, ROM, etc.). Examples of magnetic recording apparatus that may be used in addition to memory 1004, or in place of the memory 1004, include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW.

For example, information or data can be transmitted from or received by the interface 1002, such as received sensor data and information as to a number of passengers awaiting transport in a floor elevator waiting area or a number of passengers in an inner area inside an elevator car, and transmitted information or data as to a determined transport path or determined transport paths for a corresponding one or more elevator cars, for example. Such information or data can be organized in the memory 1004 and transmitted to or from the memory 1004, such as a computer readable memory, at 1012 to the controller/processor 1006 or at 1010 to the interface 1002, for example.

Operations are performed by the controller/processor 1006, which can be any suitable type of computer implemented device, such as a computer processor, for example, as discussed. Also, the resulting information, resulting data or resulting determination made by the controller/processor 1006 from the information or data processed by the controller/processor 1006 can be stored in the memory 1004 and can be transmitted through the interface 1002, such as to one or more of the controllers or processors in the smart elevator system, such as to implement a determined transport path or to provide information or data to be displayed to passengers awaiting elevator service or currently being serviced by the at least one elevator car on the display 109, such as a digital display, for example, in an area near an elevator door. The display 109, such as a digital display, can show a number of passengers currently inside the at least one elevator car, whether the at least one elevator car is full, and the estimated time of arrival of the at least one elevator car to the corresponding floor, for example.

Embodiments of smart elevator systems and the methods for operating smart elevator systems, such as can be implemented through the use of one or more sensor apparatuses, memories and processors, for example, can also include for the master or primary processor to transmit the selected elevator path to the elevator car and the selected elevator path as can be displayed on a display associated with the elevator car, such as a computer monitor or digital screen, such as the display 109. Also, embodiments of smart elevator systems and the methods for operating smart elevator systems can also include for the master or primary processor to transmit passenger traffic information as can be displayed on a display associated with the elevator car, such as a computer monitor or digital screen, such as the display 109.

Further, embodiments of smart elevator systems and the methods for operating smart elevator systems can also include for the master or primary processor to transmit the number of passengers inside a corresponding elevator car, to indicate or specify whether the corresponding elevator car is full, and an estimated time of arrival for the corresponding elevator car as can be displayed on a display associated with the elevator car, such as a computer monitor or digital screen, such as the display 109, for example.

A depiction of the digital display can be shown by referencing FIG. 1C. FIG. 1C illustrates the typical floor waiting area 100, the sensor 104, the inner elevator sensor 160, the controller 108, the digital display 109, the elevator door 156, and the inner area 158 of the elevator car. The inner area 158 of the elevator car can represent the inner area of the elevator cars 202, 436, 626, or 628 of FIG. 2, FIG. 4, FIG. 6A, or FIG. 6B, respectively, for example.

In obtaining, processing and displaying information on the display 109, the inner elevator sensor 160 can scan and detect the number of passengers inside the inner area 158 of the at least one elevator car, such as the three passengers being serviced in FIG. 1C, for example. The inner elevator sensor 160 can scan and detect as indicated by dotted lines at 162, 164 and 166 the number of passengers in the inner area 158 of the at least one elevator car and can provide the information to the controller 108, such as a controller associated with a floor elevator door, for example, although the information can also be provided to other processors, such as other controllers, central scheduling dispatchers or an overall elevator dispatcher units in an elevator system, for example. The controller 108, or other processors in the smart elevator system, can receive and organize the number of passengers in the inner area 158 of the at least one elevator car and can determine whether the at least one elevator car is empty, has space for one or more additional persons or is full. The controller 108, or other processors in the smart elevator system, can then transmit the determined passenger information to the primary processor, such as the scheduler 256, the central scheduling dispatcher 402, or the overall elevator dispatcher unit 602, as discussed, for example.

The primary processor can receive the determined passenger information from the controller 108, or other processors in the smart elevator system, and include the determined passenger information on the number of passengers currently being serviced by the at least one elevator car in the decision process along with other information for selecting one or more elevator transport paths. After the primary processor has selected at least one elevator transport path, the primary processor can also transmit, for example, a direction of the selected at least one elevator transport path, the number of passengers inside of a corresponding elevator car, whether the corresponding elevator car is empty or full, and the estimated time of arrival of the corresponding elevator car to the display 109, such as a digital display, to the corresponding one or more floors where elevator service is requested or serviced by the at least one elevator car.

The information and operations that are transmitted throughout the various embodiments of a smart elevator system or methods for operating an elevator system can be in the form of electronic data, wireless signals, or a variation thereof. The information and operations that are transmitted throughout the various embodiments can be sent wirelessly, optically, or by any of various types or arrangements of hard wire connections, or combinations thereof, among the various system components, for example.

It is to be understood that the present invention is not limited to the embodiments described above, but encompasses any and all embodiments within the scope of the following claims.

We claim:

1. A smart elevator system including one or more elevator cars, comprising:

a plurality of sensors, at least one of the plurality of sensors associated with a floor elevator door of a corresponding elevator car on a floor of a structure or associated with the corresponding elevator car, wherein the sensors detect a number of persons awaiting elevator service at one or more corresponding floors in the structure or receiving elevator service of a corresponding elevator car and transmit data signals of the number of persons detected, the number of persons detected including a number of persons detected within a downward elevator transport zone and a number of persons detected within an upward elevator transport zone of a designated waiting area;

one or more receiving processors associated with one or more floor elevator doors or associated with one or more corresponding elevator cars, wherein the one or more receiving processors receive the data signals transmitted from one or more corresponding sensors and determine passenger traffic data corresponding to data signals; and at least one master processor associated with a corresponding one or more elevator cars in the structure, wherein the at least one master processor receives the passenger traffic data from the one or more receiving processors or from one or more corresponding sensors in the smart elevator system and determines at least one transport path to at least one floor location for corresponding one or more elevator cars, based on the received passenger traffic data, the at least one transport path including selective upward or downward movement of the one or more elevator cars dependent upon the transmitted data signals representative of the number of persons detected within the downward elevator transport zone and the number of persons detected within the upward elevator transport zone.

2. The smart elevator system according to claim 1, further comprising at least one display for a corresponding elevator car located on a corresponding at least one floor of the structure to selectively display elevator service information, the elevator service information being selected from the group consisting of: a number of persons in an inner area of the corresponding elevator car, a current capacity of the corresponding elevator car, a time of arrival of the corresponding elevator car at a corresponding floor, and combinations thereof, wherein the elevator service information displayed is based on information transmitted by at least one of a corresponding at least one master processor or a corresponding receiving processor.

3. The smart elevator system according to claim 1, wherein the sensors are wireless sensors to wirelessly communicate the data signals of the number of persons detected.

4. The smart elevator system according to claim 1, wherein the one or more receiving processors transmit the passenger traffic data to one or more other receiving processors.

5. The smart elevator system according to claim 1, wherein at least one master processor is associated with at least one elevator car and receives the passenger traffic data from one or more receiving processors and determines the transport path to a floor location for the at least one elevator car.

6. The smart elevator system according to claim 1, wherein the at least one master processor is distinct and separate from at least one elevator car and receives the passenger traffic data from one or more receiving processors and determines the transport path to the floor location for the at least one elevator car.

7. The smart elevator system according to claim 1, wherein the at least one master processor transmits at least one selection decision as to the determined at least one transport path to a floor location to corresponding one or more elevator cars directing the one or more elevator cars to a corresponding floor elevator door on a floor in the structure.

8. The smart elevator system according to claim 7, wherein the at least one master processor is distinct and separate from at least one elevator car and receives the passenger traffic data from one or more receiving processors and determines the transport path to the floor location for the at least one elevator car.

9. The smart elevator system according to claim 1, wherein at least one master processor is a central master processor distinct and separate from one or more other master processors and receives the passenger traffic data from the one or more other master processors and determines at least one transport path to at least one floor location for the one or more elevator cars in the structure, based on the received passenger traffic data.

10. A method for operating an elevator system, the method comprising the steps of:

scanning by one or more sensors an area on at least one floor outside of at least one floor elevator door on one or more corresponding floors to detect a number of persons awaiting elevator service;

receiving by the one or more sensors scanning the at least one floor outside of at least one floor elevator door on the one or more corresponding floors data regarding the number of persons awaiting elevator service, the number of persons including a number of persons detected within a downward elevator transport zone and a number of persons detected within an upward elevator transport zone of a designated waiting area;

transmitting data signals corresponding to the number of persons awaiting elevator service detected by the one or more sensors to at least one receiving processor;

determining by at least one receiving processor passenger traffic data corresponding to the transmitted data signals;

transmitting the determined passenger traffic data regarding the number of persons awaiting elevator service to at least one master processor; and determining by at least one master processor at least one transport path to at least one floor location for one or more elevator cars, based on the received passenger traffic data, the at least one transport path including selective upward or downward movement of the one or more elevator cars dependent upon the transmitted data signals representative of the number of persons detected within the downward elevator transport zone and the number of persons detected within the upward elevator transport zone.

11. The method of claim 10, further comprising the steps of:

scanning by at least one sensor an inner area of a corresponding elevator car to detect the number of persons in the inner area inside the elevator car;

receiving by the at least one sensor scanning the inner area of the corresponding elevator car data regarding the number of persons in the inner area of the elevator car;

transmitting data signals corresponding to the number of persons in the inner area of the corresponding elevator car detected by the at least one sensor to at least one receiving processor or at least one master processor;

determining by at least one receiving processor or at least one master processor the number of persons in the inner area inside the corresponding elevator car based on the transmitted data signals corresponding to the number of persons in the inner area of the corresponding elevator car; and displaying on a display for the corresponding elevator car elevator service information, the elevator service information being selected from the group consisting of: a number of persons in the inner area of the corresponding elevator car, a current capacity of the corresponding elevator car, a time of arrival of the corresponding elevator car at a corresponding floor, and combinations thereof.

12. The method of claim 10, further comprising the steps of:

receiving by at least one master processor the determined passenger traffic data from at least one receiving processor; and directing by at least one master processor at least one elevator car to a respective destination corresponding to the determined transport path to the corresponding floor location.

13. The method of claim 10, further comprising the step of directing by at least one master processor one or more elevator cars to respective one or more destinations corresponding to the at least one determined transport path to at least one corresponding floor location.

14. The method of claim 10, further comprising the step of receiving the determined passenger traffic data from one or more receiving processors by at least one master processor, the at least one master processor being distinct and separate from the one or more elevators cars.

15. The method of claim 14, further comprising the step of directing by the at least one master processor one or more elevator cars to respective one or more destinations corresponding to the at least one determined transport path to at least one corresponding floor location.

16. The method of claim 10, wherein the one or more sensors are wireless sensors to wirelessly communicate the data signals of the number of persons detected.

17. A computer implemented smart elevator system, the system comprising:

a plurality of sensors, at least one of the plurality of sensors associated with a floor elevator door of a corresponding floor associated with a corresponding elevator car, wherein the plurality of sensors detect a number of persons awaiting elevator service at one or more corresponding floors and transmit data signals of the number of persons detected, the number of persons detected including a number of persons detected within a downward elevator transport zone and a number of persons detected within an upward elevator transport zone of a designated waiting area;

at least one first computer implemented device, the at least one first computer device including a processor and a program stored in a memory, the program directing the at least one first computer implemented device to perform the following including:

determining passenger traffic data corresponding to the transmitted data signals; and transmitting the determined passenger traffic data to at least one second computer implemented device;

and the at least one second computer implemented device, the at least one second computer device including a processor and a program stored in a memory, the program directing the at least one second computer implemented device to perform the following including:

receiving the passenger traffic data from at least one corresponding first computer implemented device;

determining at least one transport path to a corresponding floor location for corresponding one or more elevator cars, based on the received passenger traffic data; and directing one or more elevator cars to respective one or more destinations corresponding to the one or more determined transport paths, the at least one transport path including selective upward or downward movement of the one or more elevator cars dependent upon the transmitted data signals representative of the number of persons detected within the downward elevator transport zone and the number of persons detected within the upward elevator transport zone.

18. The computer implemented smart elevator system of claim 17, wherein the plurality of sensors are wireless sensors to wirelessly communicate the data signals of the number of persons detected.

* * * * *